US005187058A

United States Patent [19]

Inoue

[11] Patent Number: 5,187,058

[45] Date of Patent: Feb. 16, 1993

[54] SILVER HALIDE PHOTOGRAPHIC MATERIAL

[75] Inventor: Nobuaki Inoue, Kanagawa, Japan

[73] Assignee: Fuji Photo Film Co., Ltd., Kanagawa, Japan

[21] Appl. No.: 810,344

[22] Filed: Dec. 16, 1991

Related U.S. Application Data

[63] Continuation of Ser. No. 555,954, Jul. 20, 1990, abandoned.

[30] Foreign Application Priority Data

Jul. 20, 1989 [JP] Japan ..... 1-187701
Sep. 14, 1989 [JP] Japan ..... 1-239275

[51] Int. Cl.[5] ..... G03C 1/035

[52] U.S. Cl. ..... 430/567; 430/264; 430/569; 430/583; 430/584; 430/585; 430/588; 430/605; 430/957

[58] Field of Search ..... 430/264, 567, 569, 957, 430/583, 584, 585, 588, 605

[56] References Cited

U.S. PATENT DOCUMENTS 4,210,450 7/1980 Corben ..... 430/567
4,684,604 8/1987 Harder ..... 430/375
4,704,349 11/1987 Kriebel ..... 430/406
4,722,884 2/1988 Inoue et al. ..... 430/446
4,883,737 11/1989 Yamamoto ..... 430/138
4,999,276 3/1991 Kuwabara et al. ..... 430/264
5,006,445 4/1991 Yagihara et al. ..... 430/264

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A negative silver halide photographic material comprising a support having thereon at least one light-sensitive silver halide emulsion layer containing a silver halide emulsion containing regular silver halide grains containing from 0.3 mol % to 3.0 mol % of silver iodide, the silver halide grains being produced by conversion of silver halide host grains using high silver iodide silver halide grains having a silver iodide content of at least 90 mol % in an amount sufficient to provide from 0.1 mol % to 2.5 mol % of silver iodide based on the total silver halide content of the silver halide host grains and the high silver iodide grains.

The photographic material containing silver halide grains having a novel structure provides a negative image having excellent photographic characteristics, particularly high sensitivity and ultrahigh contrast.

A method of forming an ultrahigh contrast image which is excellent in line image quality using a stable developing solution is also disclosed.

26 Claims, No Drawings

SILVER HALIDE PHOTOGRAPHIC MATERIAL

This is a continuation of application Ser. No. 07/555,954 filed Jul. 20, 1990, now abandoned.

FIELD OF THE INVENTION

The present invention relates to a silver halide photographic material, and more particularly to a silver halide photographic material using a silver halide emulsion having a novel structure which exhibits excellent photographic characteristics.

BACKGROUND OF THE INVENTION

Various investigations have been made for many years on silver halide photographic materials to obtain a high image density ($D_{max}$) and a high sensitivity in spite of using a small amount of silver. In particular, the need for rapid processing of silver halide photographic materials has recently increased. Therefore, it is an important subject to reduce the amount of silver, more specifically to obtain an emulsion of high sensitivity containing fine grains from the standpoint of shortening a time for fixing, washing with water and drying.

On the other hand, in the field of photo-mechanical processes, there are demands for photographic light-sensitive materials having satisfactory image reproducibility, stability of processing solutions, and simplification of replenishment in order to handle the recent diversity and complexity of printed materials.

In particular, originals in line work are comprised of photo-composed letters, hand-written letters, illustrations, dot prints, etc. and thus contain images having different densities or line widths. It has been keenly demanded to develop a process camera, a photographic light-sensitive material or an image formation system which enables good reproducibility of the original. In the photomechanical process for catalogues or large posters, on the other hand, enlargement or reduction of a dot print is widely conducted. When a dot print is enlarged in plate making, the line number becomes small and the dots are blurred. When a dot print is reduced, the line number/inch becomes larger and the dots become finer than the original. Accordingly, an image formation system having a broader latitude has been demanded for maintaining reproducibility of halftone gradation.

A halogen lamp or a xenon lamp is employed as a light source of a process camera. In order to obtain photographic sensitivity to these light sources, photographic materials are usually subjected to orthochromatic sensitization. However, such orthochromatic materials are more susceptible to influences of chromatic aberration of a lens and thus liable to image quality deterioration. The deterioration is conspicuous when using a xenon lamp as a light source.

Known systems meeting the demand for broad latitude include a method comprising processing a lithographic silver halide light-sensitive material comprising silver chlorobromide (containing at least 50% of silver chloride) with a hydroquinone developer having an extremely low effective sulfite ion concentration (usually 0.1 mol/l or less) to thereby obtain a line or dot image having high contrast and high density in which image areas and non-image areas are clearly distinguished as described, for example, in *The Journal of Photographic Science,* 293, Vol. 22 (1974), A Review of the Chemistry of Lith (Infections) Development (by M. Austin). According to this method, however, development is extremely unstable against air oxidation due to the low sulfite concentration of the developer. Hence, various efforts and devices are required to stabilize the developing activity and, also, the processing speed is quite low, to reduce working efficiency.

An image formation system is desired which eliminates the image formation instability associated with the above-described lith development system and provides a ultrahigh contrast image by using a processing solution having satisfactory preservation stability. In this connection, it has been proposed to develop a surface latent image type silver halide photographic material containing a specific acylhydrazine compound with a developing solution having a pH between 11.0 and 12.3 and containing at least 0.15 mol/l of a sulfite preservative and thereby exhibiting satisfactory preservation stability to form a ultrahigh contrast negative image having a gamma exceeding 10, as disclosed in U.S. Pat. Nos. 4,166,742, 4,168,977, 4,221,857, 4,224,401, 4,243,739, 4,272,606, and 4,311,781. In this new image formation system, silver iodobromide and silver chloroiodobromide as well as silver chlorobromide can be used, while the conventional ultrahigh contrast image formation systems are only applicable to photographic materials comprising silver chlorobromide of high silver chloride content.

While the above-described image formation system exhibits excellent performance in dot quality, stability of processing, rapidness of processing, and reproducibility of originals, a system in which reproducibility of originals is further improved is desired to handle the recent diversity of printed materials.

In systems using hydrazines, silver iodide is introduced into silver halide grains for various purposes as described in JP-A-61-29837, JP-A-62-55643 and JP-A-64-61744 (the term "JP-A" as used herein means an "unexamined published Japanese patent application") as well as the above mentioned patents.

Silver halide emulsions containing silver halide grains obtained by epitaxial growth of silver halide which has a halide composition different from that of host grains are described in U.S. Pat. Nos. 4,142,900, 4,463,087 and 4,471,050, JP-A-59-119344, JP-A-59-119350, JP-A-55-163532, JP-A-56-27134, JP-A-55-161229, JP-A-58-108526 and JP-A-62-7040. Further, conversion of corner sites of cubic silver halide grains having a silver chloride content of not less than 90 mol % with silver bromide is described in Japanese Patent Application No. 62-324567 (corresponding to JP-A-1-166039).

Incorporation of redox compound capable of releasing a development inhibitor upon being oxidized into systems using hydrazines is described in JP-A-61-213847 and JP-A-64-72140.

SUMMARY OF THE INVENTION

An object of the present invention is to provide a silver halide photographic material which has a high sensitivity and a high contrast.

Another object of the present invention is to provide a silver halide photographic material of very high sensitivity which provides a ultrahigh contrast image having a gamma exceeding 10 excellent in line image quality using a stable developing solution.

Other objects of the present invention will become apparent from the following detailed description and examples.

It has now been found that these and other objects of the present invention are accomplished by a negative silver halide photographic material comprising a support having thereon at least one light-sensitive silver halide emulsion layer comprising a silver halide emulsion comprising regular silver halide grains containing from 0.3 mol % to 3.0 mol % of silver iodide, the silver halide grains being produced by conversion of silver halide host grains using high silver iodide silver halide grains having a silver iodide content of at least 90 mol % in an amount sufficient to provide from 0.1 mol % to 2.5 mol % of silver iodide based on the total silver halide content of the silver halide host grains and the high silver iodide grains.

The present invention also relates to a method for forming an image which comprises the steps of (a) imagewise exposing the above-described negative silver halide photographic material, comprising a support and at least one light-sensitive silver halide emulsion layer, at least one hydrophilic colloid layer thereof containing a hydrazine derivative and a redox compound capable of releasing a development inhibitor upon being oxidized and (b) developing the exposed material with a developing solution having a sulfite ion concentration of at least 0.15 mol/l and a pH of from 10.5 to 12.3 to produce a negative image.

DETAILED DESCRIPTION OF THE INVENTION

The silver halide grains according to the present invention are described in greater detail below.

The halide composition of host crystals is preferably silver bromide or silver iodobromide. In the case of silver iodobromide, the silver iodide content is preferably not more than 2.5 mol %, and more preferably not more than 1 mol %. The halide composition of silver halide grains used for conversion is preferably silver iodide, silver iodobromide, silver iodochlorobromide or silver iodochloride, each having a silver iodide content of not less than 90 mol %, and particularly preferably silver iodide.

The amount of silver iodide used for conversion is an amount which provides a silver iodide content of from 0.1 mol % to 2.5 mol %, preferably from 0.3 mol % to 1.5 mol %, based on the total amount of silver halide grains (i.e., host grains and conversion grains).

The average silver iodide content per grain of silver halide grains (i.e., host grains and conversion grains) subjected to the conversion is not more than 3 mol %, preferably not more than 2.5 mol %, and more preferably from 0.5 mol % to 2.0 mol %. When the silver iodide content exceeds 3.0 mol %, the formation of undesirable black pepper frequently occurs.

The mean grain size of the host grains according to the present invention is preferably not more than 0.7 μm, more preferably from 0.2 μm to 0.5 μm. With respect to grain size distribution, a monodisperse emulsion is preferred.

The mean grain size of the conversion grains according to the present invention is preferably at most 0.1 μm.

The terminology "monodisperse emulsion" as used herein means a silver halide emulsion composed of silver halide grains having a grain size distribution, the coefficient of variation as defined below of which is not more than 20%, and preferably not more than 15%.

*Coefficient of Variation* (%) $= A/B \times 100$

A: Standard deviation of grain sizes

B: Mean value of grain sizes

The silver halide grains in the silver halide emulsion are generally classified into a regular crystal structure, for example, a cubic, octahedral or tetradecahedral structure, an irregular crystal structure, for example, a spherical or tabular structure, a crystal defect, for example, a twin plane, and a composite structure thereof.

The preparation of silver halide grains according to the present invention starts with the formation of regular host crystals. Specifically, cubic grains, tetradecahedral grains or octahedral grains can be prepared by addition of an aqueous solution of a soluble silver salt and an aqueous solution of a soluble halide while maintaining silver ion concentration constant.

The introduction of conversion grains can be performed by simultaneous addition of an aqueous solution of a soluble halide and an aqueous solution of a soluble silver salt in amounts corresponding to the specific molar number to a tank containing the host crystals, or addition of a super-fine grain emulsion having the silver iodide content of not less than 90 mol % which has been previously prepared.

The introduction of the fine grain emulsion previously prepared is preferably performed using a device as described in Japanese Patent Application No. 63-7851 (corresponding to JP-A-1-183417) and Japanese Patent Application Nos. 63-310651 and 1-27172.

In order to increase selectivity of silver iodide conversion in the present invention, it is preferred to conduct the conversion in the presence of a compound capable of adsorbing to silver halide grains represented by formula (A):

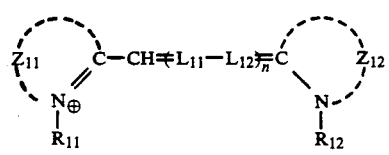

(A)

wherein $Z_{11}$ and $Z_{12}$, which may be the same of different each represents an atomic group necessary for forming a thiazole nucleus, a thiazoline nucleus, a benzothiazole nucleus, a naphthothiazole nucleus, an oxazole nucleus, a benzoxazole nucleus, an oxazoline nucleus, a naphthoxazole nucleus, an imidazole nucleus, a benzimidazole nucleus, an imidazoline nucleus, a selenazole nucleus, a selenazoline nucleus, a benzoselenazole nucleus, or a naphthoselenazole nucleus; $R_{11}$ and $R_{12}$, which may be the same or different, each represents a substituted or unsubstituted alkyl group, provided that at least one of $R_{11}$ and $R_{12}$ comprises a sulfo group or a carboxy group; $L_{11}$ and $L_{12}$ each represents a substituted or unsubstituted methine group; and n represents 0, 1 or 2.

The nucleus formed by $Z_{11}$ or $Z_{12}$ may have a substituent(s) as is well known in the art of cyanine dyes. Examples of the substituents include an alkyl group, an alkoxy group, an alkoxycarbonyl group, an aryl group, an aralkyl group, and a halogen atom.

The alkyl group represented by $R_{11}$ or $R_{12}$ preferably includes those having from 1 to 8 carbon atoms, e.g., methyl, ethyl, propyl, butyl, pentyl, and heptyl. Substituents for the alkyl group include a carboxy group, a sulfo group, a cyano group, a halogen atom (e.g., fluorine, chlorine and bromine), a hydroxyl group, an alkoxycarbonyl group (having not more than 8 carbon atoms, e.g., methoxycarbonyl, ethoxycarbonyl, and benzyloxycarbonyl), an alkoxy group (having not more than 7 carbon atoms, e.g., methoxy, ethoxy, propoxy, butoxy, and benzyloxy), an aryloxy group (e.g., phenoxy, and p-tolyloxy), an acyloxy group (having not more than 3 carbon atoms, e.g., acetyloxy, and propionyloxy), an acyl group (having not more than 8 carbon atoms, e.g., acetyl, propionyl, benzoyl, and mesyl), a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, and morpholinosulfonyl), and an aryl group (e.g., phenyl, p-hydroxyphenyl, p-carboxylphenyl, p-sulfophenyl, and α-naphthyl). The substituted alkyl group preferably has 6 or less carbon atoms.

Substituents for the methine group represented by $L_{11}$ or $L_{12}$ include a lower alkyl group (e.g., methyl, ethyl, and propyl), a phenyl group, and a benzyl group.

Specific examples of the cyanine dye suitable for use in the present invention are set forth below, but the present invention is not to be construed as being limited thereto.

A-1)

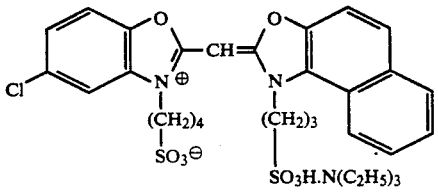

A-2)

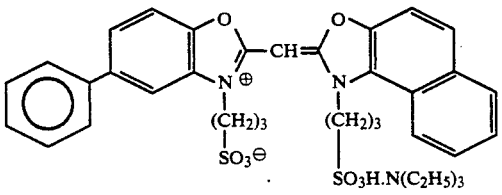

A-3)

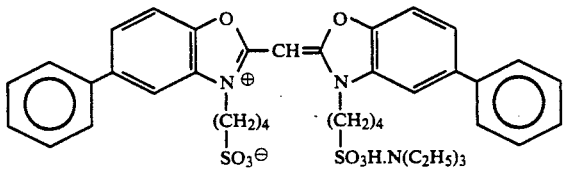

A-4)

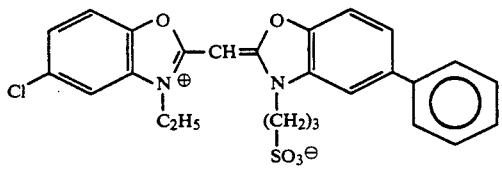

A-5)

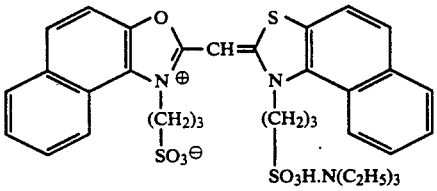

A-6)

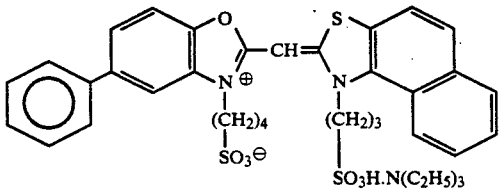

-continued
A-7)
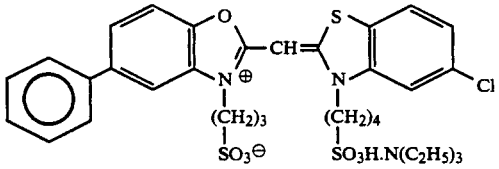
A-8)
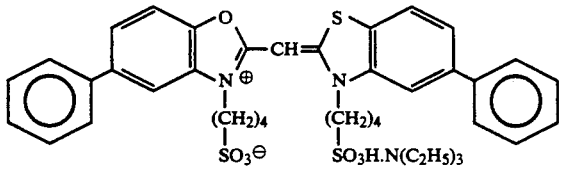
A-9)
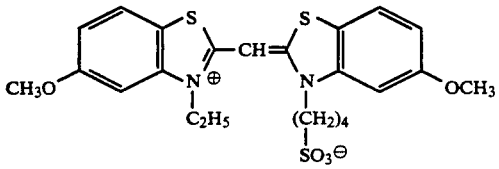
A-10)
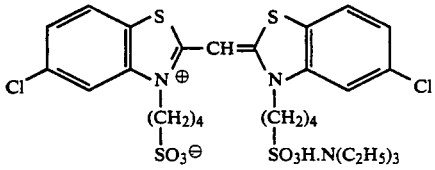
A-11)
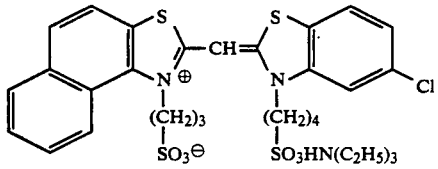
A-12)
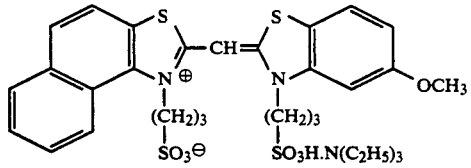
A-13)
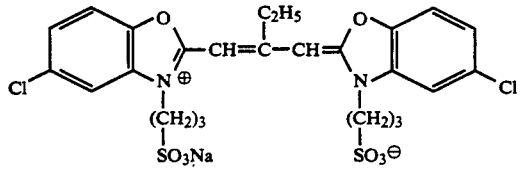
A-14)
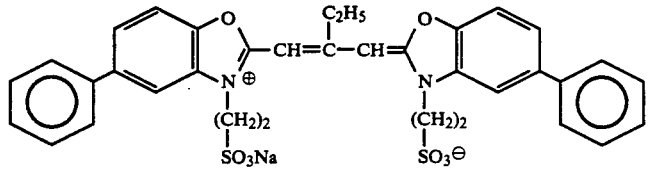

-continued
A-15)
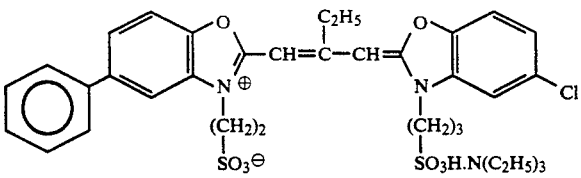
A-16)
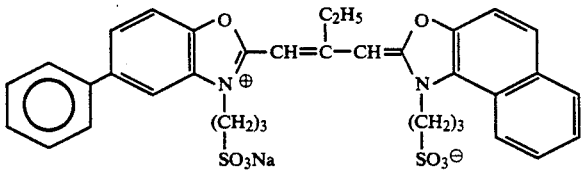
A-17)
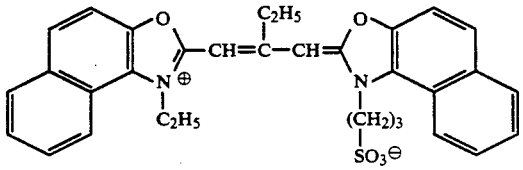
A-18)
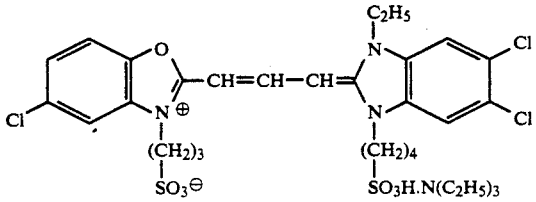
A-19)
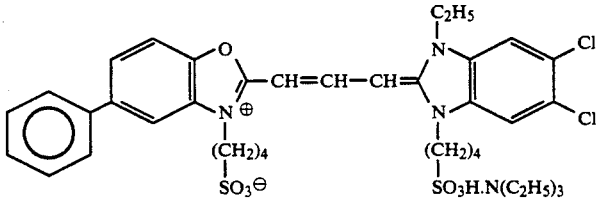
A-20)
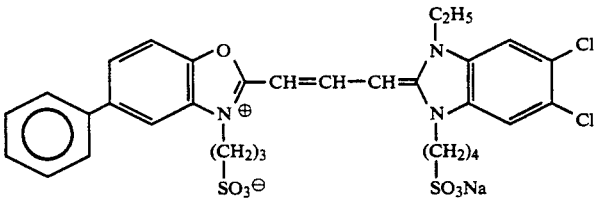
A-21)
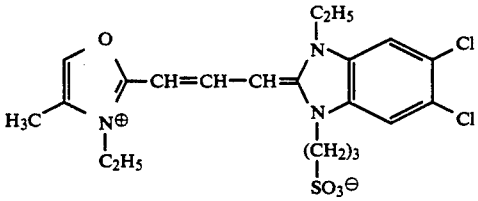
A-22)
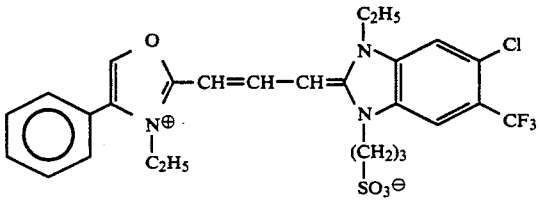

-continued

A-23)

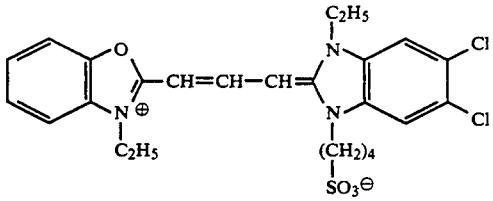

A-24)

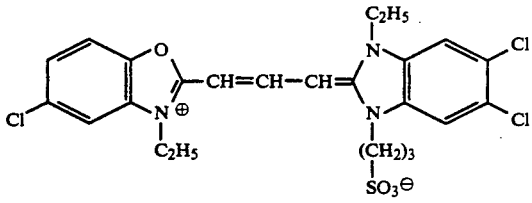

A-25)

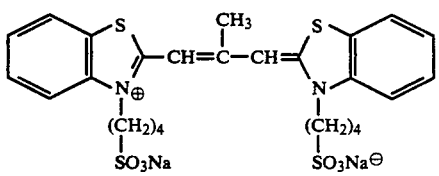

Examples of the cyanine dye more preferable for use in the present invention include those wherein $Z_{11}$ and $Z_{12}$ each represents an atomic group necessary for forming a benzothiazole nucleus or a benzoxazole nucleus and $R_{11}$ and $R_{12}$ each represents a sulfo group-substituted alkyl group having from 2 to 4 carbon atoms.

The amount of the compound represented by formula (A) used in the present invention is from $1\times10^{-6}$ mol to $1\times10^{-1}$ mol, and preferably from $1\times10^{-4}$ mol to $1\times10^{-2}$ mol, per mol of silver contained in all silver halide grains.

The host crystals for use in the present invention can be prepared according to the methods described, for example, in P. Glafkides, *Chimie et Physique Photographique,* (Paul Montel, 1967); G. F. Duffin, *Photographic Emulsion Chemistry,* (Focal Press, 1966), and V. L. Zelikman et al., *Making and Coating Photographic Emulsion,* (Focal Press, 1964).

That is, the emulsion can be prepared by an acid method, a neutral method, or an ammonia method. For reacting a soluble silver salt and a soluble halide, a single jet method, a double jet method, or a combination thereof may be employed. A reverse mixing method of forming silver halide grains in the presence of excess silver ions can also be used. The controlled double jet method wherein a constant pAg is maintained in a liquid phase for forming the silver halide grains can also be used. According to this method, a silver halide emulsion containing silver halide grains having a regular crystal form and a substantially uniform grain size can be obtained.

Also, for preparing uniform silver halide grains, it is preferred to quickly grow the grains below critical saturation by adjusting the addition rates of the silver nitrate and the alkali metal halide according to the growth rate of the silver halide grains as described in British Patents 1,535,016, JP-B-48-36890 and JP-B-52-16364 (the term "JP-B" as used herein means an "examined Japanese patent publication"), or by a method of changing the concentrations of the aqueous silver salt solution and the aqueous halide solution as described in U.S. Pat. No. 4,242,445 and JP-A 55 158124.

Silver halide solvents can be used in preparing the silver halide emulsion of the present invention. Examples of the silver halide solvent used are (a) organic thioethers as described in U.S. Pat. Nos. 3,271,157, 3,531,289, and 3,574,628, (b) thiourea derivatives as described in JP-A-53-82408 and JP-A-55-77737, (c) silver halide solvents having an oxygen atom or a carbonyl group as described in JP-A-53-144319, (d) imidazoles, (e) sulfites, and (f) thiocyanates as described in JP-A-54-100717. Of these silver halide solvents, the thioethers are particularly preferred.

Specific examples of the thioether are set forth below.

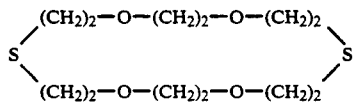

$CH_2-NHCOCH_2CH_2COOH$
$CH_2-S-CH_2CH_2SC_2H_5$ $HO-(CH_2)_2-S-(CH_2)_2-S-(CH_2)_2-OH$

The amount of the silver halide solvents employed in preparing the silver halide emulsion of the present invention is preferably from $2\times10^{-6}$ mol to $2\times10^{-3}$ mol per mol of silver.

In the course of formation or physical ripening of silver halide grains for use in the present invention, a cadmium salt, a lead salt, a thallium salt, a rhodium salt or a complex salt thereof, an iridium salt or a complex salt thereof may be present in the system.

A silver halide which is particularly suitable for use in the present invention is silver halide which is prepared in the presence of from $10^{-8}$ to $10^{-5}$ mol of an iridium salt or a complex salt thereof per mol of silver. It is preferred to add the prescribed amount of the iridium salt by the end of physical ripening, and more particularly during grain formation. The iridium salt to be added includes a water-soluble iridium salt or a complex salt thereof, e.g., iridium trichloride, iridium tetrachloride, potassium hexachloroiridate (III), potassium hexachloroiridate (IV), and ammonium hexachloroiridate (III).

The silver halide emulsion used in the present invention may or may not be subjected to chemical sensitization. For the chemical sensitization, known methods, for example, a sulfur sensitization method, a reduction sensitization method and a gold sensitization method are employed individually or in a combination. Preferred chemical sensitization is sulfur sensitization.

As the sulfur sensitizer, sulfur compounds contained in gelatin and various sulfur compounds such as thiosulfates, thioureas, thiazoles, or rhodanines may be used. Specific examples thereof are described in U.S. Pat. Nos. 1,574,944, 2,278,947, 2,410,689, 2,728,668, 3,501,313, and 3,656,955. Preferred sulfur compounds are thiosulfates and thioureas.

The pAg at the chemical sensitization is preferably not more than 8.3, and more preferably in a range of from 7.3 to 8.0. Further, a method using polyvinyl pyrrolidone together with a thiosulfate as described in Moisar and Klein, *Gelatine. Proc. Symp.*, 2nd., page 301 to 309 (1970) provides a preferred result.

The gold sensitization method is a representative example of noble metal sensitization methods and gold compounds, mainly gold complex salts are employed therein. A complex salt of a noble metal other than gold, for example, platinum, palladium, or iridium may be employed. Specific examples thereof are described in U.S. Pat. No. 2,448,060 and British Patent 618,061.

As the reduction sensitizer, stanuous salts, amines, formamidinesulfinic acid, silane compounds, etc., may be used. Specific examples thereof are described in U.S. Pat. Nos. 2,487,850, 2,518,698, 2,983,609, 2,983,610 and 2,694,637.

In the photographic light-sensitive material according to the present invention, it is possible to use only one kind of silver halide emulsion. Also, two or more silver halide emulsions (for example, those differing in average grain size, halide composition, crystal habit or condition of chemical sensitization) can be employed in a mixture.

The hydrazine derivative which can be used in the present invention is preferably a compound represented by formula (I):

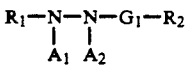

(I)

wherein $R_1$ represents an aliphatic group or an aromatic group; $R_2$ represents hydrogen, an alkyl group, an aryl group, an alkoxyl group, an aryloxy group, an amino group, a hydrazino group, a carbamoyl group, or an oxycarbonyl group; $G_1$ represents a carbonyl group, a sulfonyl group, a sulfoxy group,

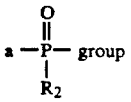

(wherein $R_2$ is as defined above),

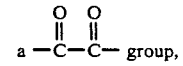

a thiocarbonyl group, or an iminomethylene group; $A_1$ and $A_2$ each represents hydrogen, or one of $A_1$ and $A_2$ represents hydrogen, and the other represents a substituted or unsubstituted alkylsulfonyl group, a substituted or unsubstituted arylsulfonyl group, or a substituted or unsubstituted acyl group.

In formula (I), the aliphatic group represented by $R_1$ is preferably an aliphatic group containing from 1 to 30 carbon atoms, and more preferably a straight chain, branched or cyclic alkyl group having from 1 to 20 carbon atoms. The branched alkyl group may be cyclized to form a saturated heterocyclic ring containing at least one hetero atom. Further, the alkyl group may be substituted with an aryl group, an alkoxyl group, a sulfoxy group, a sulfonamido group, or a carbonamido group.

The aromatic group represented by $R_1$ in formula (I) is a monocyclic or bicyclic aryl group or an unsaturated heterocyclic group. The unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those containing a benzene ring being particularly preferred.

$R_1$ particularly preferably represents an aryl group.

The aryl group or unsaturated heterocyclic group represented by $R_1$ may have a substituent typically including, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphonamido group, a diacylamino group, an imido group, and

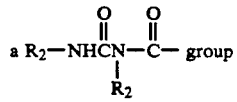

(wherein $R_2$ is as defined above). Preferred examples of the substituent include a straight chain, branched or cyclic alkyl group (preferably having from 1 to 20 carbon atoms), an aralkyl group (preferably a monocyclic or bicyclic group having from 1 to 3 carbon atoms in the alkyl moiety thereof), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphonamido group (preferably having from 1 to 30 carbon atoms).

The alkyl group represented by $R_2$ in formula (I) preferably contains from 1 to 4 carbon atoms and may have a substituent, e.g., a halogen atom, a cyano group, a carboxy group, a sulfo group, an alkoxyl group, a phenyl group, an acyl group, an alkoxycarbonyl group, an aryloxycarbonyl group, a carbamoyl group, an alkylsulfo group, an arylsulfo group, a sulfamoyl group, a nitro group, a heteroaromatic group, and

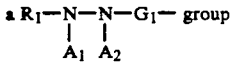

(wherein $R_1$, $A_1$, $A_2$ and $G_1$ each is as defined above). These groups may further be substituted.

The aryl group represented by $R_2$ preferably includes a monocyclic or bicyclic aryl group, such as those containing a benzene ring. The aryl group may have one or more substituents including those described for the alkyl group above.

The alkoxyl group represented by $R_2$ preferably contains from 1 to 8 carbon atoms and may be substituted, for example, with a halogen atom, or an aryl group.

The aryloxy group represented by $R_2$ is preferably monocyclic and may be substituted, for example, with a halogen atom.

The amino group represented by $R_2$ may be substituted, for example, with an alkyl group, a halogen atom, a cyano group, a nitro group, or a carboxyl group. Preferably included in the amino group are an unsubstituted amino group, an alkylamino group having from 1 to 10 carbon atoms, and an arylamino group.

The carbamoyl group represented by $R_2$ may be substituted, for example, with an alkyl group, a halogen atom, a cyano group, or a carboxy group. Preferably included in the carbamoyl group are an unsubstituted carbamoyl group, an alkylcarbamoyl group having from 1 to 10 carbon atoms, and an arylcarbamoyl group.

The oxycarbonyl group represented by $R_2$ preferably includes an alkoxycarbonyl group having from 1 to 10 carbon atoms and an aryloxycarbonyl group. The oxycarbonyl group may be substituted, for example, with an alkyl group, a halogen atom, a cyano group, or a nitro group.

Where $G_1$ is a carbonyl group, $R_2$ preferably represents hydrogen, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, and 4-methanesulfonylphenyl), and more preferably a hydrogen atom.

Where $G_1$ is a sulfonyl group, $R_2$ preferably represents an alkyl group (e.g., methyl), an aralkyl group (e.g., o-hydroxyphenylmethyl), an aryl group (e.g., phenyl), or a substituted amino group (e.g., dimethylamino).

Where $G_1$ is a sulfoxy group, $R_2$ preferably represents a cyanobenzyl group or a methylthiobenzyl group.

Where $G_1$ is

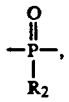

each $R_2$ preferably represents a methoxy group, an ethoxy group, a butoxy group, a phenoxy group, or a phenyl group, and more preferably a phenoxy group.

Where $G_1$ is an N-substituted or unsubstituted iminomethylene group, $R_2$ preferably represents a methyl group, an ethyl group, or a substituted or unsubstituted phenyl group.

Substituents for $R_2$ include those enumerated above as the substituents of $R_1$.

In formula (I), $G_1$ most preferably represents a carbonyl group.

$R_2$ may be a group which makes the $G_1$—$R_2$ moiety split off from the remainder of formula (I) to induce cyclization producing a cyclic structure containing the —$G_1$—$R_2$ moiety. More specifically, such a group is represented by formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder; $R_3$ represents a group derived by removing one hydrogen from $R_2$; and $R_3$ and $Z_1$ form a cyclic structure together with $G_1$ upon nucleophilic attack of $Z_1$ on $G_1$.

In more detail, when the hydrazine compound of formula (I) undergoes any reaction such as oxidation to produce an intermediate represented by the formula of $R_1$—N=N—$G_1$—$R_3$—$Z_1$, $Z_1$ easily reacts nucleophilically with $G_1$ to split $R_1$—N=N from $G_1$. Such a group as $Z_1$ includes (a) a functional group capable of directly reacting with $G_1$, e.g., OH, SH, $NHR_4$ (wherein $R_4$ represents hydrogen, an alkyl group, an aryl group, —$COR_5$, or —$SO_2R_5$ (wherein $R_5$ represents hydrogen, an alkyl group, an aryl group, or a heterocyclic group)), and —COOH (these functional groups may be temporarily protected so as to release the functional group upon hydrolysis with an alkali); and (b) a functional group which becomes capable of reacting with $G_1$ on reacting with a nucleophilic agent (e.g., a hydroxide ion and a sulfite ion), such as

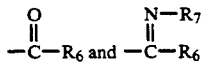

(wherein $R_6$ and $R_7$ each represents hydrogen, an alkyl group, an alkenyl group, an aryl group, or a heterocyclic group).

The ring formed by $G_1$, $R_3$, and $Z_1$ is preferably a 5-membered or 6-membered ring.

Preferred groups represented by formula (a) are represented by formula (b) or (c) described below.

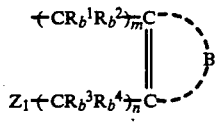

(b)

wherein $Z_1$ is as defined above; $R_b^1$, $R_b^2$, $R_b^3$, $R_b^4$, which may be the same or different, each represents hydrogen, an alkyl group (preferably having from 1 to 12 carbon atoms), an alkenyl group (preferably having from 2 to 12 carbon atoms), or an aryl group (preferably having from 6 to 12 carbon atoms). B represents an atomic group necessary to form a substituted or unsubstituted 5-membered or 6-membered ring; m and n each represents 0 or 1; and (n+m) is 1 or 2.

In the formula (b), the 5-membered or 6-membered ring formed by B includes, for example, cyclohexene, cycloheptene, benzene, naphthalene, pyridine, and quinoline rings.

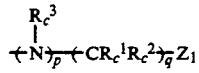

(c)

wherein $Z_1$ is as defined above: $R_c^1$ and $R_c^2$, which may be the same or different, each represents hydrogen, an alkyl group, an alkenyl group, an aryl group, or a halogen atom. $R_c^3$ represents hydrogen, an alkyl group, an alkenyl group, or an aryl group; p represents 0 or 1; q represents an integer of from 1 to 4; $R_c^1$, $R_c^2$, and $R_c^3$ may be linked to form a ring as long as $Z_1$ is capable of intramolecular nucleophilic attack on $G_1$.

$R_c^1$ and $R_c^2$ each preferably represents hydrogen, a halogen atom, or an alkyl group, and $R_c^3$ preferably represents an alkyl group or an aryl group.

q preferably represents 1 to 3. When q is 1, p represents 0 or 1; when q is 2, p represents 0 or 1; when q is 3, p represents 0 or 1; and when q is 2 or 3, the $CR_c^1R_c^2$ moieties may be the same or different.

In formula (1), $A_1$ and $A_2$ each represents hydrogen, an alkylsulfonyl or arylsulfonyl group having not more than 20 carbon atoms (preferably a phenylsulfonyl group or a phenylsulfonyl group which is substituted so that the sum of Hammett's substituent constants is −0.5 or more), an acyl group having not more than 20 carbon atoms (preferably a benzoyl group, a benzoyl group which is substituted so that the sum of Hammett's substituent constants is −0.5 or more), or a straight chain, branched or cyclic, substituted or unsubstituted aliphatic acyl group (the substituent includes a halogen atom, an ether group, a sulfonamido group, a carbonamido group, a hydroxy group, a carboxy group, and a sulfo group)).

$A_1$ and $A_2$ each preferably represents hydrogen.

$R_1$ or $R_2$ in formula (I) may contain a ballast group commonly employed in immobile photographic additives such as couplers or may form a polymer. A ballast group is a group which contains at least 8 carbon atoms and is relatively inert in photographic characteristics. Suitable examples of the ballast groups are selected from an alkyl group, an alkoxy group, a phenyl group, an alkylphenyl group, a phenoxy group, and an alkylphenoxy group. Further, suitable examples of the polymers include those described in JP-A-1-100530.

$R_1$ or $R_2$ in formula (I) may further contain a group which accelerates adsorption onto surfaces of silver halide grains (hereinafter referred to as an adsorption accelerating group). Examples of such an adsorption accelerating groups include a thiourea group, a heterocyclic thioamido group, a mercapto heterocyclic group, and a triazole group as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, Japanese Patent Application Nos. 62-67508, 62-67509 and 62-67510 (corresponding to JP-A-63-234244, JP-A-63-234245 and JP-A-63-234246, respectively).

Specific examples of the hydrazine derivative represented by formula (I) are set forth below, but the present invention is not to be construed as being limited thereto.

I-1)

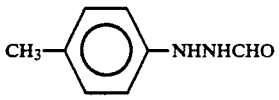

I-2)

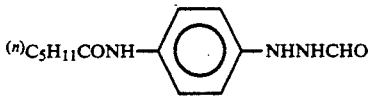

I-3)

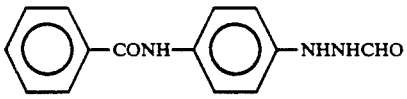

I-4)

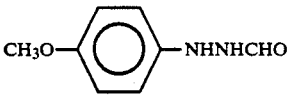

I-5)

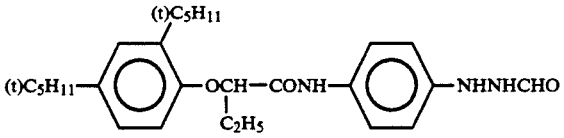

I-6)

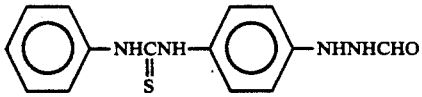

I-7)

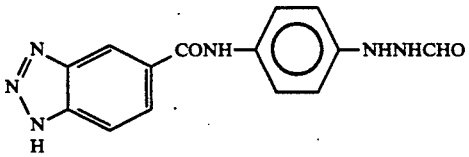

I-8)

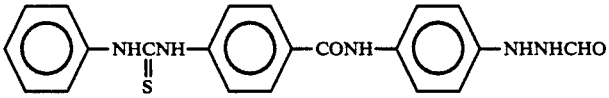

-continued
I-9)
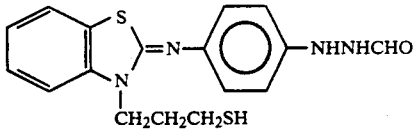
I-10)
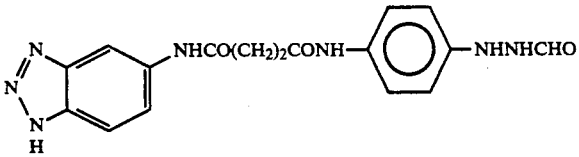
I-11)
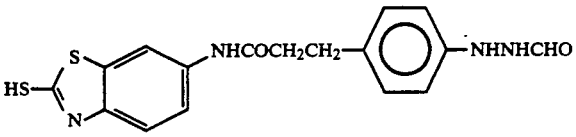
I-12)
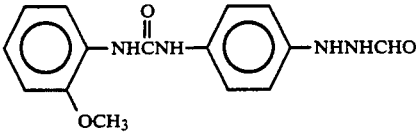
I-13)
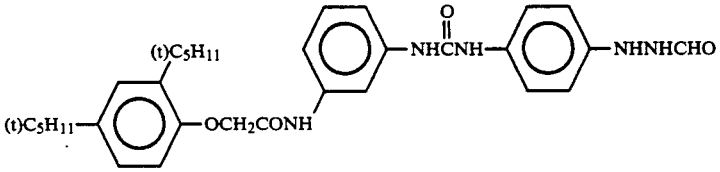
I-14)
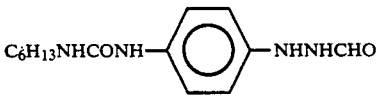
I-15)
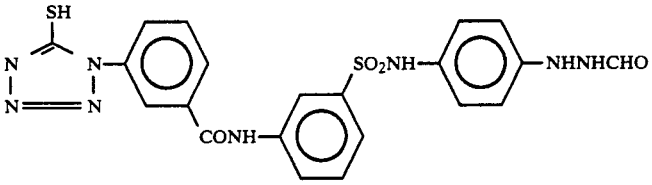
I-16)
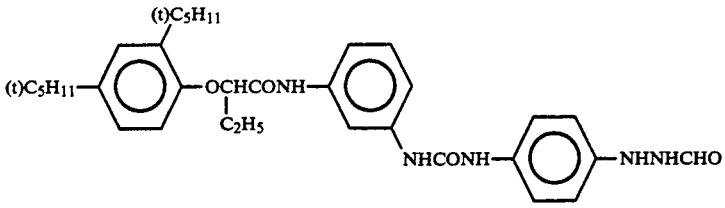
I-17)
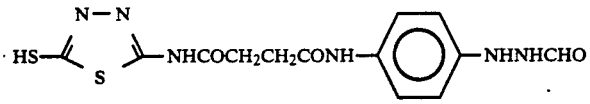
I-18)
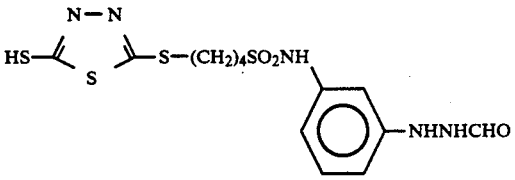
I-19)
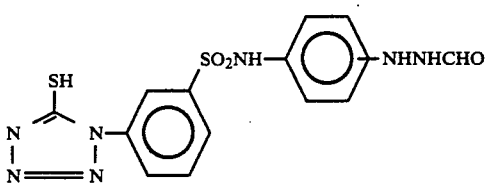

-continued
I-20)
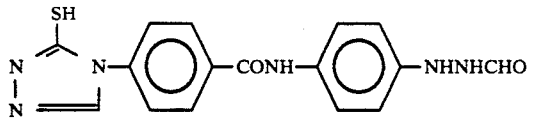
I-21)
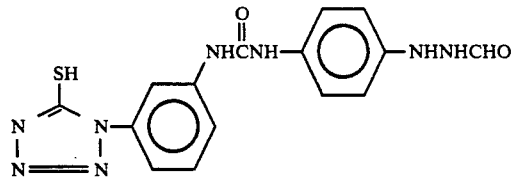
I-22)
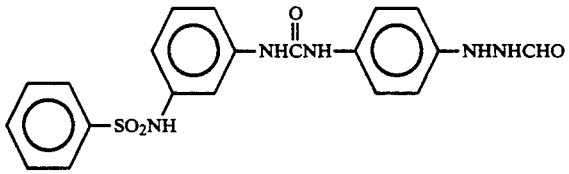
I-23)
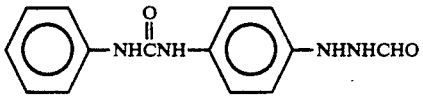
I-24)
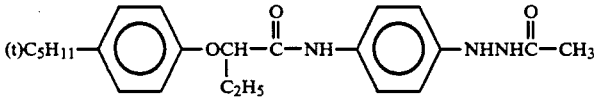
I-25)
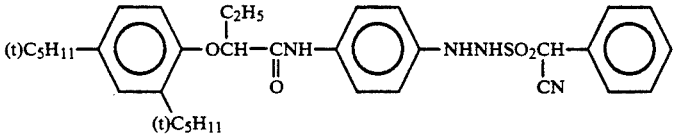
I-26)
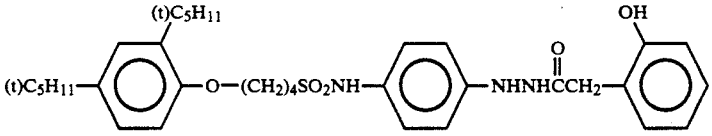
I-27)
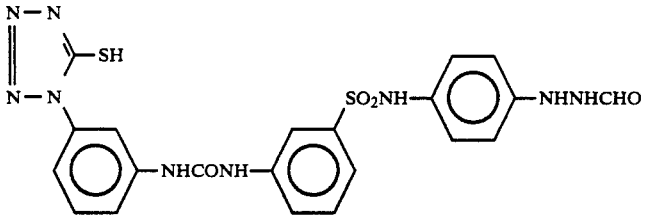
I-28)
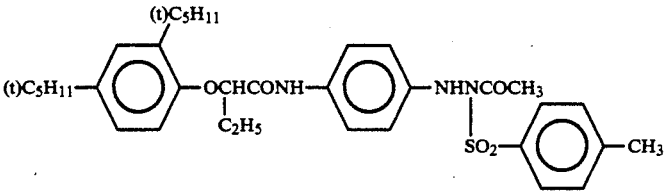
I-29)
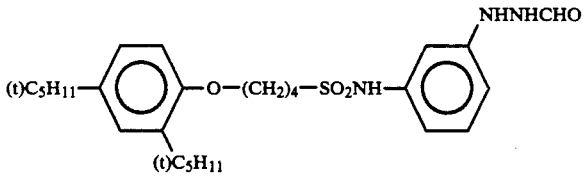

-continued
I-30)
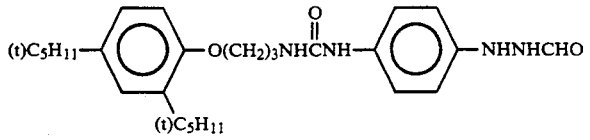
I-31)
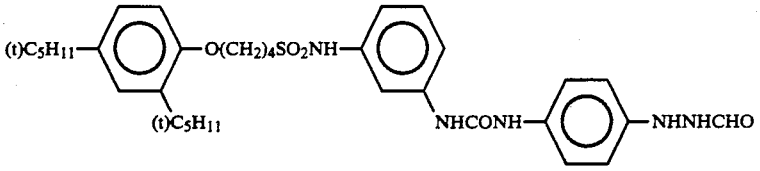
I-32)
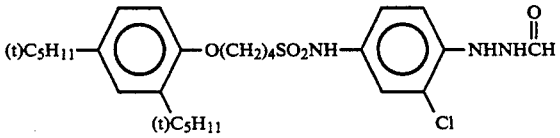
I-33)
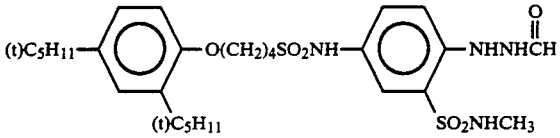
I-34)
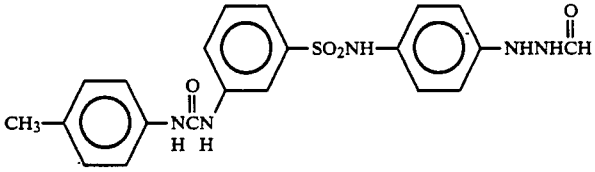
I-35)
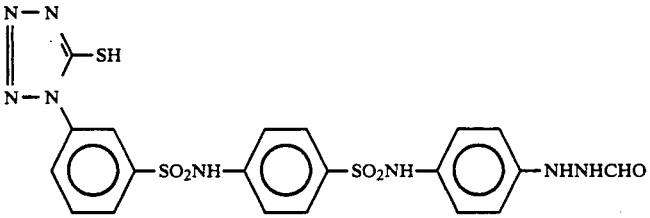
I-36)
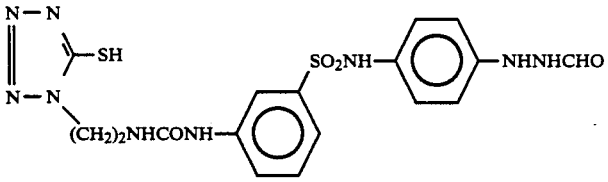
I-37)
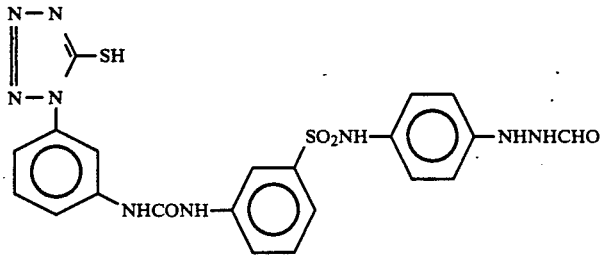

-continued
I-38)
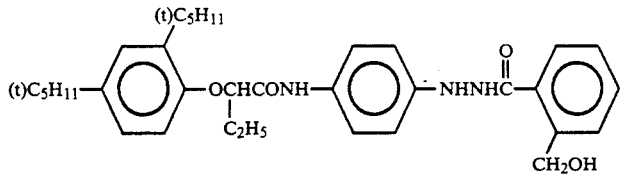
I-39)
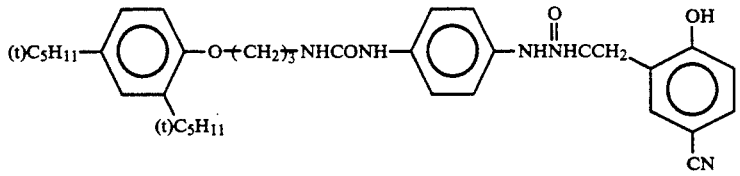
I-40)
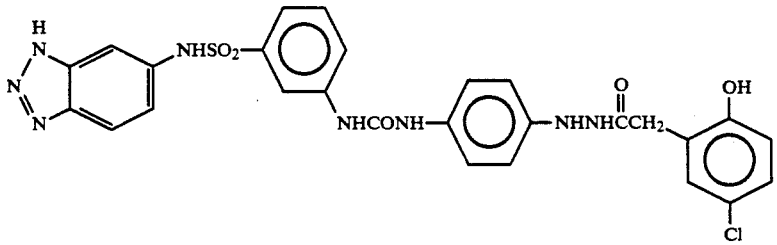
I-41)
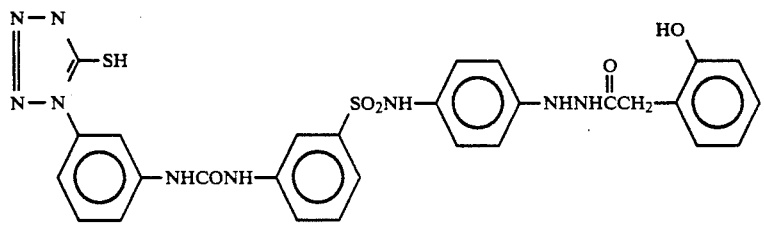
I-42)
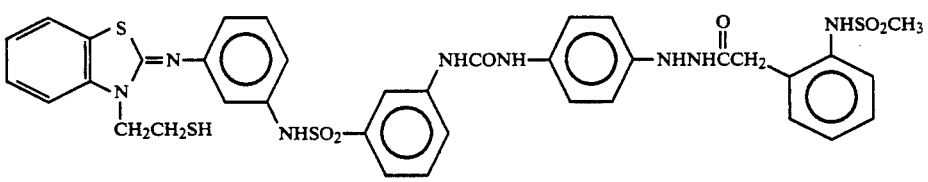
I-43)
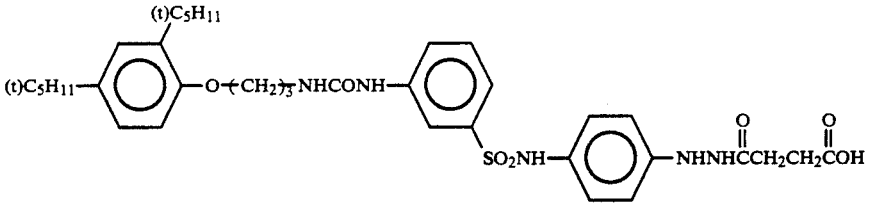
I-44)
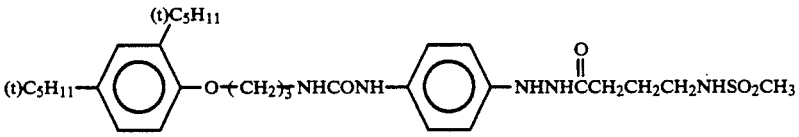
I-45)
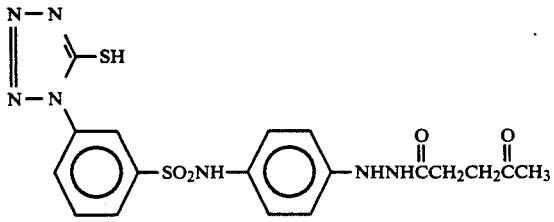

-continued
I-46)
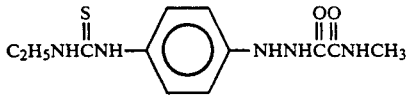
I-47)
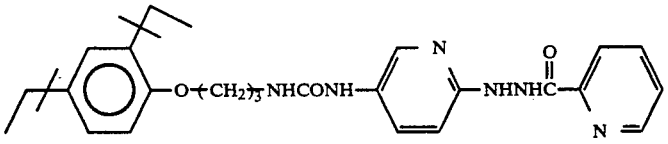
I-48)
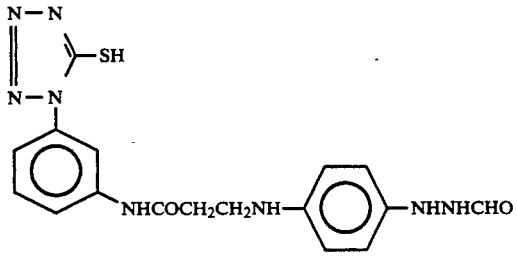
I-49)
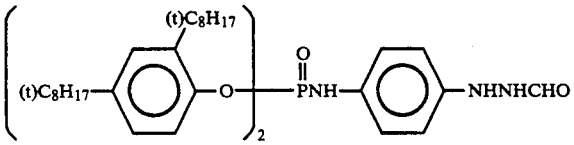
I-50)
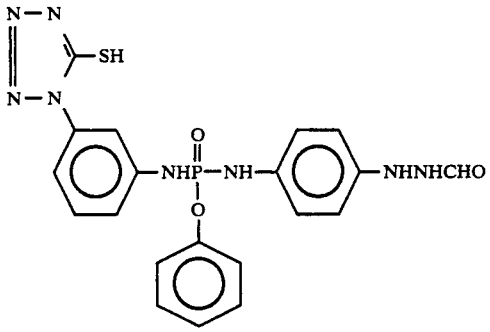
I-51)
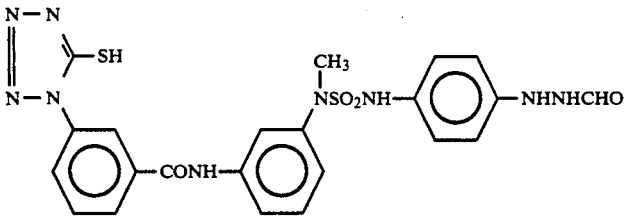
I-52)
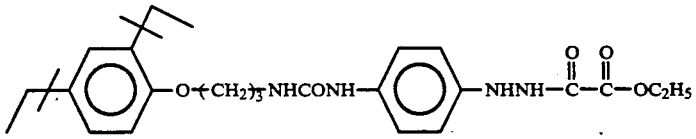
I-53)
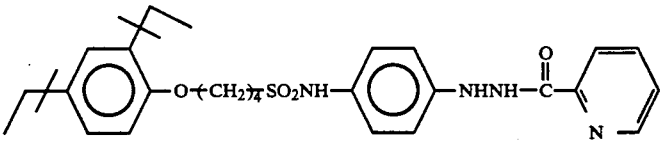

-continued
I-54)
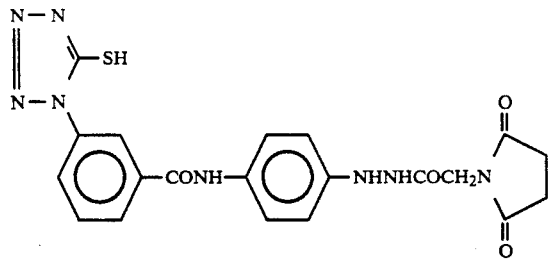
I-55)
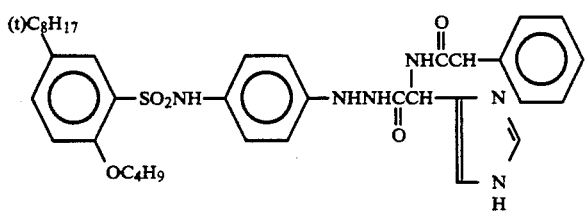
I-56)
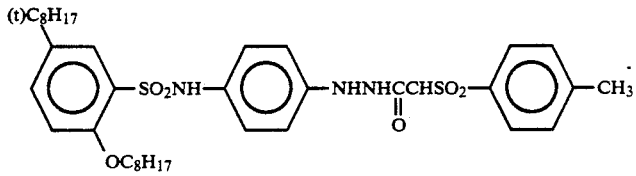
I-57)
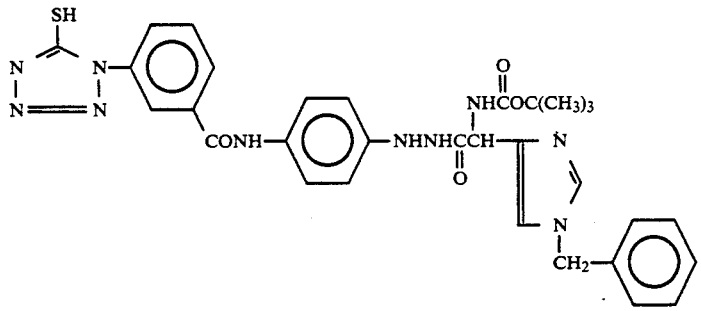
I-58)
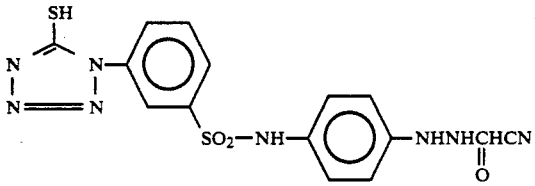
I-59)
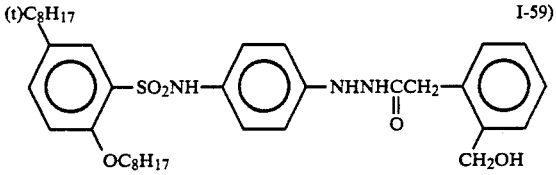
I-60)
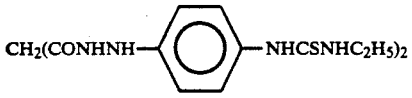
I-61)
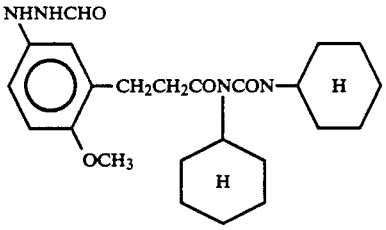
I-62)
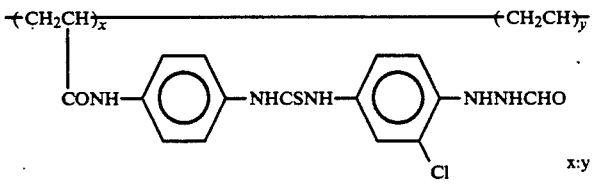
x:y = 97:3
In addition to the above, it is also possible to use, as the hydrazine derivatives according to the present invention, those described in and in the references cited in *Research Disclosure,* No. 23516 (November, 1983), page 346, and those described in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61 170733, JP-A-61-270744, JP-A-62-948, European Patent 217,310, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, Japanese Patent Application Nos. 63-105682, 63-114118, 63-110051, 63-114119 and 63-116239 (corresponding to JP-A-1-276128, JP-A-1-283548, JP-A-1-280747, JP-A-1-283549 and JP-A-1-285940, respectively), and Japanese Patent Application Nos. 63-147339, 63-179760, 63-229163, 1-18377, 1-18378, 1-18379, 1-15755, 1-16814, 1-40792, 1-42615, 1-42616, 1-123693 and 1-126284.

The amount of the hydrazine derivative employed in the present invention is preferably from $1\times10^{-6}$ mol to $5\times10^{-2}$ mol, and particularly preferably from $1\times10^{-5}$ mol to $2\times10^{-2}$ mol, per mol of silver halide.

In the redox compound capable of releasing a development inhibitor upon being oxidized which can be employed in the present invention, the redox group includes, for example, a hydroquinone moiety, a catechol moiety, a naphthohydroquinone moiety, an aminophenol moiety, a pyrazolidone moiety, a hydrazine moiety, a hydroxylamine moiety and a reductone moiety. Among them, the hydrazine moiety is preferred as the redox group. Particularly, a compound represented by formula (II) is preferred as the redox compound.

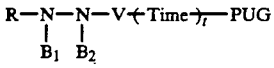

(II)

wherein $B_1$ and $B_2$ each represents hydrogen or one of them represents hydrogen and the other represents a sulfinic acid group or

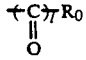

(wherein $R_0$ represents an alkyl group, an alkenyl group, an aryl group, an alkoxy group or an aryloxy group; and l represents 1 or 2); Time represents a divalent linking group; t represents 0 or 1; PUG represents a development inhibitor group; V represents a carbonyl group,

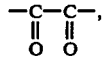

a sulfonyl group, a sulfoxy group,

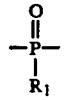

(wherein $R_1$ represents an alkoxy group or an aryloxy group), an iminomethylene group or a thiocarbonyl group; and R represents an aliphatic group, an aromatic group or a heterocyclic group.

The compound represented by formula (II) is now described in greater detail.

In formula (II) described above, $B_1$ and $B_2$ each represents a hydrogen atom, an alkylsulfonyl or arylsulfonyl group having not more than 20 carbon atoms (preferably a phenylsulfonyl group or a phenylsulfonyl group which is substituted so that the sum of the Hammett's substituent constants may be −0.5 or more),

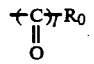

(wherein $R_0$ represents a straight chain, branched chain or cyclic alkyl group or alkenyl group preferably having not more than 30 carbon atoms, an aryl group (preferably a phenyl group or a phenyl group which is substituted so that the sum of the Hammett's substituent constants may be −0.5 or more), an alkoxy group (for example, ethoxy), or an aryloxy group (preferably a monocyclic aryloxy group). These groups may be substituted with one or more substituents. Suitable examples of the substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an aryloxycarbonyl group, an acyl group, an alkoxycarbonyl group, an acyloxy group, a carbonamido group, a sulfonamido group, a nitro group, an alkylthio group, and an arylthio group, and these substituents may be further substituted.

The sulfinic acid group represented by $B_1$ or $B_2$ preferably represents one which is specifically described in U.S. Pat. No. 4,478,928.

Further, $B_1$ may be connected with $\text{-(Time)-}_t$ to form a ring.

$B_1$ and $B_2$ are most preferably hydrogen atoms.

In formula (II), Time represents a divalent linking group and may have a timing control function. t represents 0 or 1, when t is 0, PUG is directly connected to V.

In a case wherein the divalent linking group represented by Time has the timing control function, Time represents a group which releases PUG through one or more reaction stages from Time-PUG which has been released from an oxidation product of the oxidation reduction skeleton.

The divalent linking groups represented by Time include, for example, those capable of releasing a photographically useful group (hereinafter simply referred to as "PUG") upon an intramolecular ring-closing reaction of a p-nitrophenoxy derivative as described, for example, in U.S. Pat. No. 4,248,962 (JP-A-54-145135); those capable of releasing PUG upon an intramolecular ring closing reaction after the ring cleavage as described, for example, in U.S. Pat. No. 4,310,612 (JP-A-55-53330) and U.S. Pat. No. 4,358,252; those capable of releasing PUG accompanied with the formation of an acid anhydride upon an intramolecular ring closing reaction of a carboxy group of a succinic acid monoester or analogue thereof as described, for example, in U.S. Pat. Nos. 4,330,617, 4,446,216 and 4,483,919 and JP-A-59-121328; those capable of releasing PUG accompanied with the formation of quinonemonomethane or an analogue thereof upon electron transfer via conjugated double bonds of an aryloxy group or a heterocyclic oxy group as described, for example, in U.S. Pat. Nos. 4,409,323 and 4,421,845, *Research Disclosure*, No, 21228 (December, 1981), U.S. Pat. No. 4,416,977 (JP-A-57-135944), JP-A-58-209736 and JP-A-58-209738; those capable of releasing PUG from the γ-position of enamine upon electron transfer in an enamine structure portion of a nitrogen-containing hetero ring as described, for example, in U.S. Pat. No. 4,420,554 (JP-A-57-136640), JP-A-57-135945, JP-A-57-188035, JP-A-58-98728 and JP-A-58-209737; those capable of releasing PUG upon an intramolecular ring-closing reaction of an oxy group formed by electron transfer to a carbonyl group which is conjugated with a nitrogen atom in a nitrogen-containing hetero ring as described, for example, in JP-A-57-56837; those capable of releasing PUG accompanied with the formation of an aldehyde as described, for example, in U.S. Pat. No. 4,146,396 (JP-A-52-90932), JP-A-59-93442 and JP-A-59-75475; those capable of releasing PUG accompanied with decarboxylation of a carboxy group as described, for example, in JP-A-51-146828, JP-A-57-179842 and JP-A-59-104641; those capable of releasing PUG from a structure of —O—COOCR$_2$Rb—PUG accompanied with decarboxylation and the subsequent formation of an aldehyde; those capable of releasing PUG accompanied with the formation of isocyanate as described, for example, in JP-A-60-7429; and those capable of releasing PUG upon a coupling reaction with an oxidation product of a color developing agent as described, for example, in U.S. Pat. No. 4,438,193.

Specific examples of the divalent linking group represented by Time are described in detail, for example, in JP-A-61-236549 and Japanese Patent Application No. 63-98803 (corresponding to JP-A-1-269936).

Preferred specific examples of the divalent linking groups are set forth below, wherein (*) denotes the position at which V is bonded, and (*)(*) denotes the position at which PUG is bonded, but the present invention is not to be construed as being limited thereto.

T-(1)

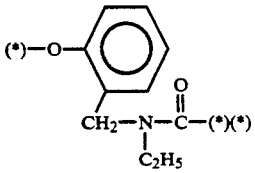

T-(2)

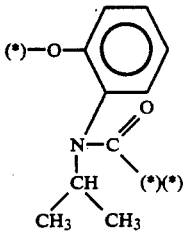

-continued

T-(3)

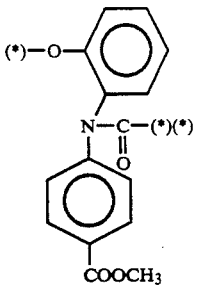

T-(4)

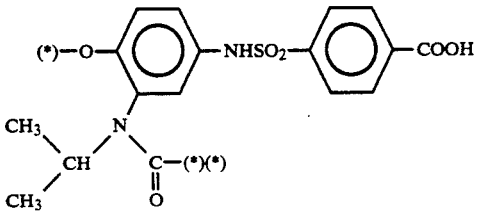

T-(5)

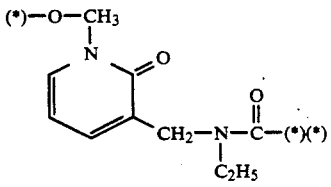

T-(6)

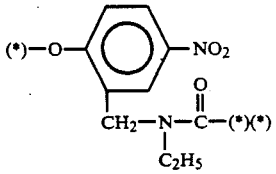

T-(7)

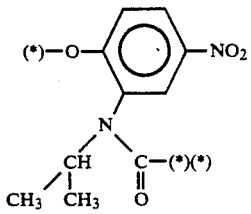

T-(8)

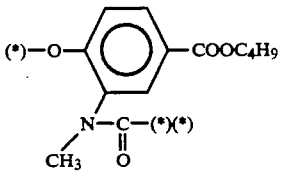

T-(9)

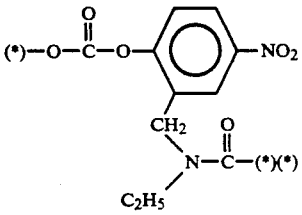

-continued
T-(10)
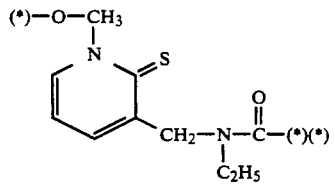
T-(11)
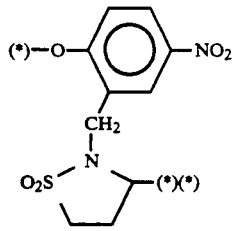
T-(12)
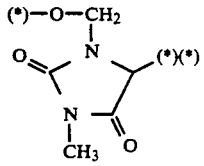
T-(13)
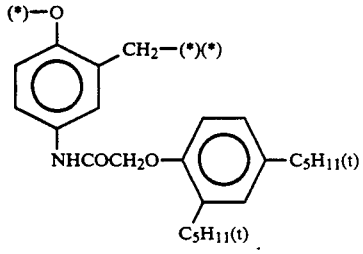
T-(14)
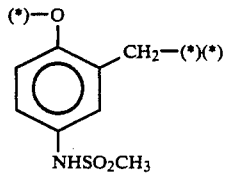
T-(15)
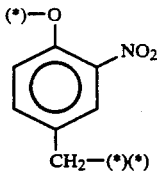
T-(16)
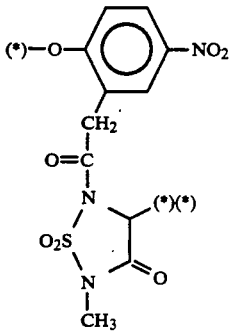
-continued
T-(17)
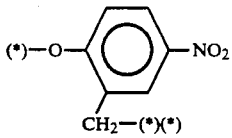
T-(18)
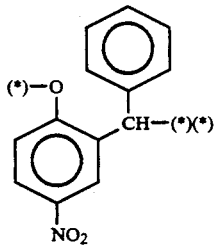
T-(19)
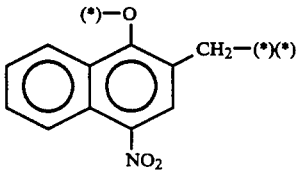
T-(20)
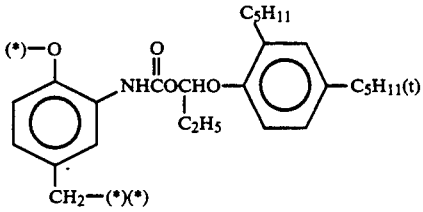
T-(21)
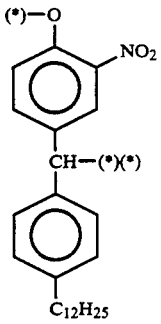
T-(22)
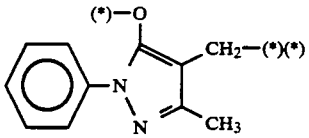
T-(23)
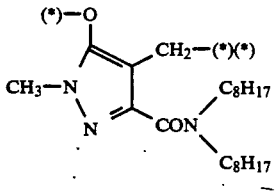
T-(24)
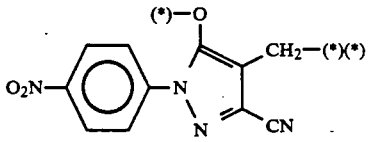

-continued

T-(25)

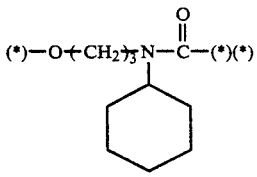

T-(26)

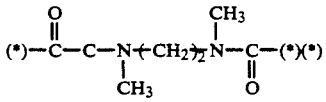

T-(27)

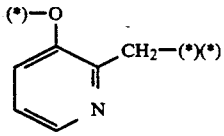

T-(28)

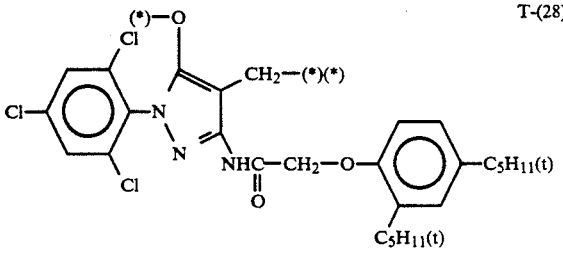

T-(29)

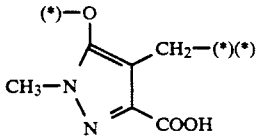

T-(30)

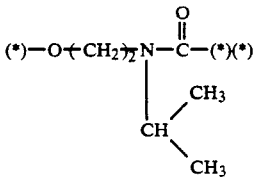

T-(31)

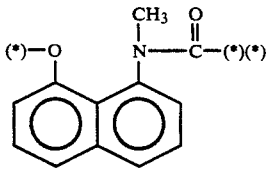

T-(32)

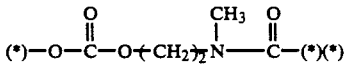

T-(33)

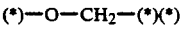

T-(34)

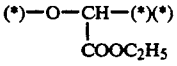

T-(35)

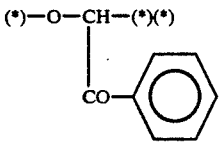

-continued

T-(36)

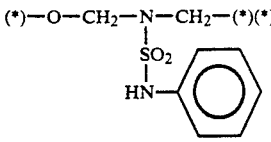

T-(37)

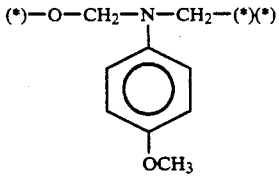

T-(38)

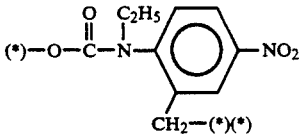

T-(39)

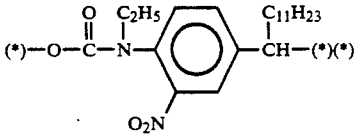

T-(40)

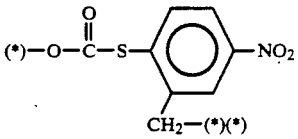

T-(41)

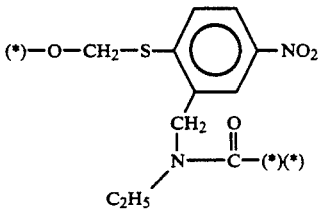

T-(42)

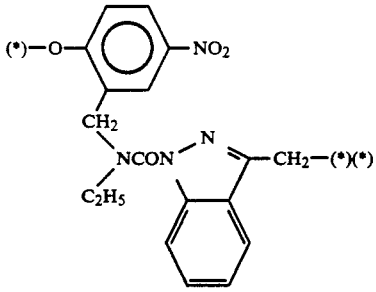

In formula (II), PUG represents a group which has a development inhibiting function as (Time)PUG or PUG.

The development inhibitor moiety represented by PUG or (Time)PUG is a known group carrying a hetero atom at which it is bonded. Examples of such groups are described in, e.g., C. E. K. Mees and T. H. James, The Theory of Photographic Processes, 3rd Ed., 344–346, (Macmillan 1966). Specific examples include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptoaryls.

The development inhibitor moiety represented by PUG may be substituted with one or more substituents. Suitable examples of the substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a sulfoxy group, a phosphono group, a phosphinyl group, and a phosphonamido group. These substituents may be further substituted.

Preferred examples of the substituents are a nitro group, a sulfo group, a carboxy group, a sulfamoyl group, a phosphono group, a phosphinyl group and a sulfonamido group.

Typical examples of the development inhibitors which can be used in the present invention are shown below, but the present invention is not to be construed as being limited thereto.

1. Mercaptotetrazole Derivatives
(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4 Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl 5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5 mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethylammonium chloride
(34) 1-(3-Phenoxycarbonylphenyl)-5-mercaptotetrazole
(35) 1-(3-Maleinimidophenyl)-6-mercaptotetrazole 2. Mercaptotriazole Derivatives
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives
(1) 1-Phenyl-2-mercaptoimidazole
(2) 1,5-Diphenyl-2-mercaptoimidazole
(3) 1-(4-Caboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Derivatives
(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-(Phenoxycarbonylmethylthio)-5-mercapto-1,3,4-thiadiazole 7. Mercaptobenzothiazole Derivatives
(1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Derivatives
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benzotriazole Derivatives
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole sodium salt

(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Derivatives
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-trifluoromethylbenzimidazole 11. Indazole Derivatives
(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole Derivatives
(1) 5-(4-Nitrophenyl)tetrazole
(2) 5-Phenyltetrazole
(3) 5-(3-Carboxyphenyl)tetrazole 13. Tetraazaindene Derivatives
(1) 4-Hydroxy-6-methyl-5-nitro-1,3,3a,7-tetrazaindene
(2) 4-Mercapto-6-methyl-5-nitro-1,3,3a,7-tetraazaindene 14. Mercaptoaryl Derivatives
(1) 4-Nitrothiophenol
(2) Thiophenol
(3) 2-Carboxythiophenol In formula (II), V represents a carbonyl group,

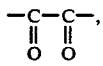

a sulfonyl group, a sulfoxy group,

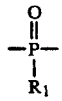

(wherein $R_1$ represents an alkoxy group or an aryloxy group), an iminomethylene group or a thiocarbonyl group, and preferably represents a carbonyl group.

The aliphatic group represented by R in formula (II) includes a straight chain, branched chain or cyclic alkyl group, alkenyl group or alkynyl group each containing preferably from 1 to 30 carbon atoms, particularly from 1 to 20 carbon atoms. The branched chain alkyl group may contain one or more hetero atoms therein to form a saturated hetero ring.

Specific examples of the aliphatic group include a methyl group, a tert-butyl group, an n-octyl group, a tert-octyl group, a cyclohexyl group, a hexenyl group, a pyrrolidyl group, a tetrahydrofuryl group and an n-dodecyl group.

The aromatic group represented by R includes a monocyclic or bicyclic aryl group, for example, a phenyl group or a naphthyl group.

The heterocyclic group represented by R includes a 3-membered to 10-membered saturated or unsaturated heterocyclic group containing at least one of a nitrogen atom, an oxygen atom and a sulfur atom, which may be a monocyclic ring or form a condensed ring together with an aromatic ring or a heterocyclic ring. A 5-membered or 6-membered aromatic heterocyclic group is preferred. Specific examples of the heterocyclic group include a pyridyl group, an imidazolyl group, a quinolinyl group, a benzimidazolyl group, a pyrimidyl group, a pyrazolyl group, an isoquinolinyl group, a benzothiazolyl group and a thiazolyl group.

The group represented by R may be substituted with one or more substituents. Suitable examples of the substituent include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxy group, and a phosphonamido group. These groups may be further substituted.

In the compound represented by formula (II), a ballast group which is conventionally employed in immobile photographic additives such as couplers, or a group which is capable of accelerating the adsorption onto silver halide may be incorporated into R or $\text{-(-Time-)}_t\text{-}$PUG of formula (II).

The ballast group is an organic group which provides a molecular weight sufficient to substantially prevent the compound represented by formula (II) from diffusion into other layers or a processing solution and includes, for example, alkyl, aryl, heterocyclic, ether, thioether, amido, ureido, urethane, sulfonamido or a combination of two or more thereof. The ballast group is preferably a ballast group containing a substituted benzene ring, and particularly a ballast group containing a benzene ring substituted with a branched alkyl group.

The adsorption accelerating group for silver halides includes specifically a cyclic thioamido group, for example, 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxadiazoline-2-thione, benzimidazoline-2-thione, benzoxazoline-2-thione, benzothiazoline-2-thione, thiotriazine and 1,3-imidazoline-2-thione, a chain thioamido group, an aliphatic mercapto group, an aromatic mercapto group, a heterocyclic mercapto group (when the atom adjacent to the carbon atom bonded to -SH group is a nitrogen atom, the heterocyclic mercapto group has the same meaning as a cyclic thioamide group which is in a tautomeric relation therewith and specific examples thereof are the same as illustrated above), a group having a disulfido bond, a 5-membered or 6-membered nitrogen-containing heterocyclic ring comprising a combination of nitrogen, oxygen, sulfur, and carbon, for example, benzotriazole, triazole, tetrazole, indazole, benzimidazole, imidazole, benzothiazole, thiazole, thiazoline, benzoxazole, oxazole, oxazoline, thiadiazole, oxadiazole, triazine and azaindene, and a heterocyclic quaternary salt, for example, benzimidazolinium.

They may be further substituted with one or more appropriate substituents.

The substituents can be selected from those described for R above.

Specific examples of the compound represented by formula (II) which can be employed in the present invention are set forth below, but the present invention is not to be construed as being limited to these compounds.

II-1.

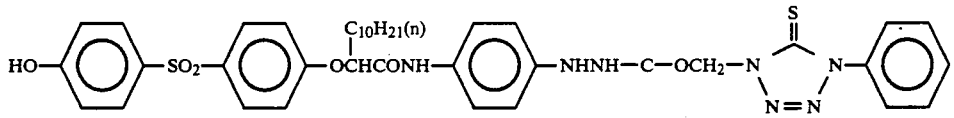

II-2.

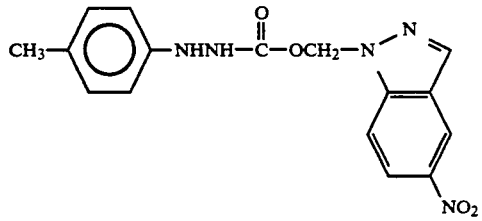

II-3.

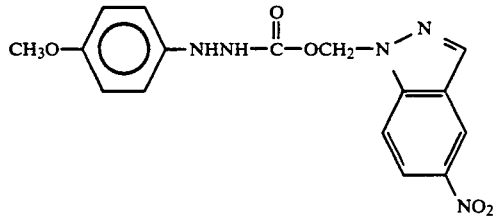

II-4.

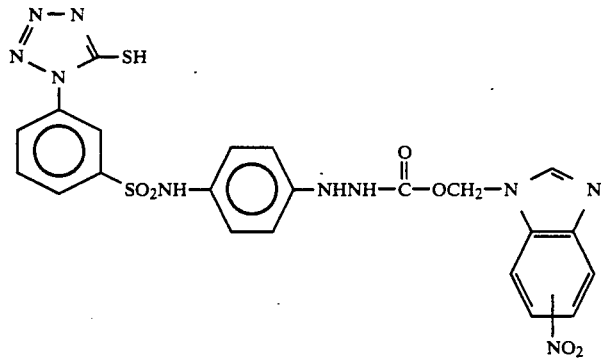

II-5.

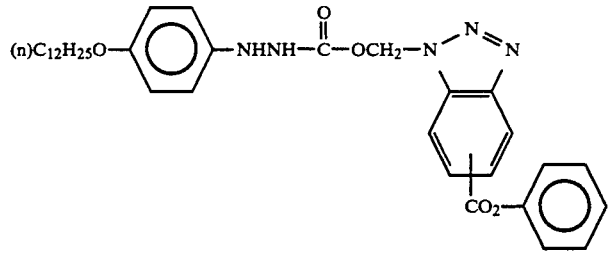

II-6.

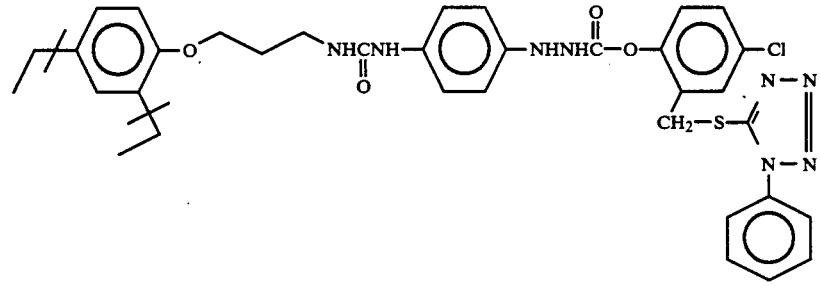

-continued
II-7.
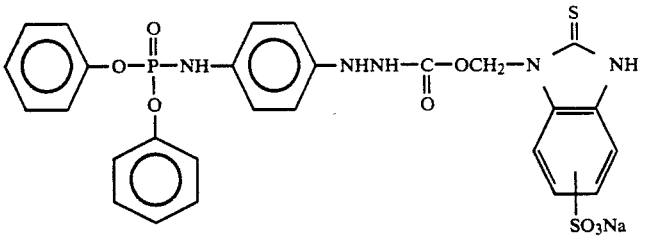
II-8.
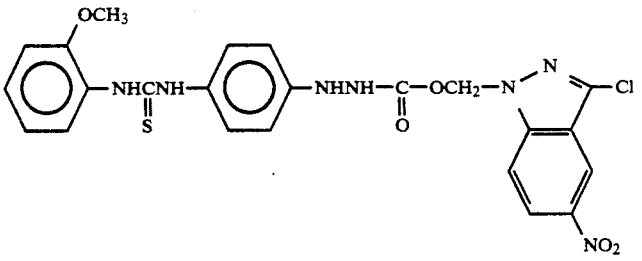
II-9.
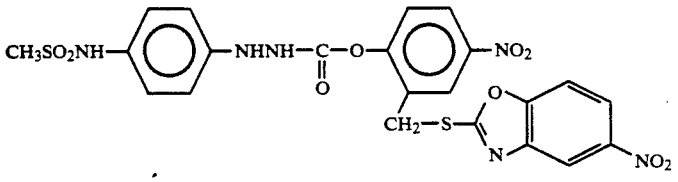
II-10.
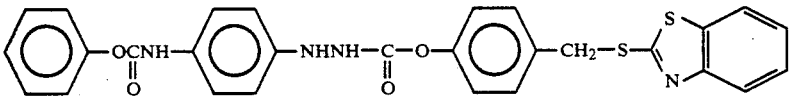
II-11.
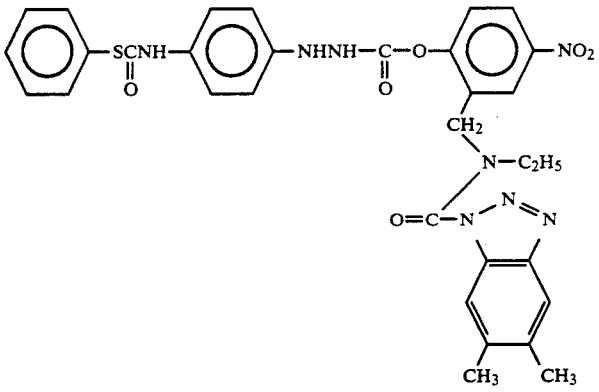
II-12.
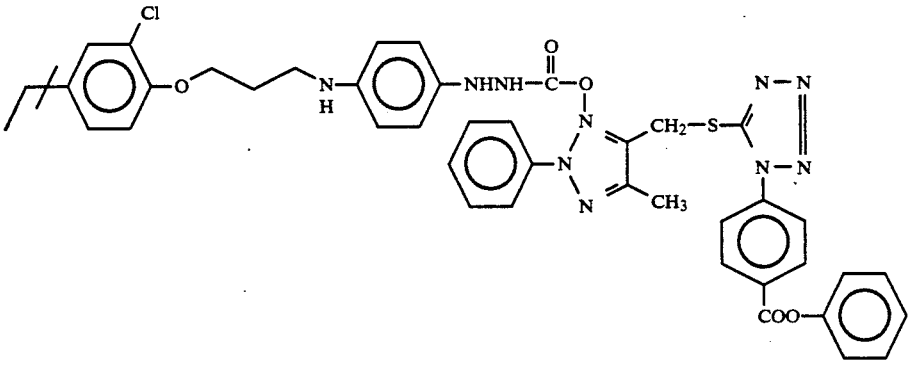

-continued .
II-13.
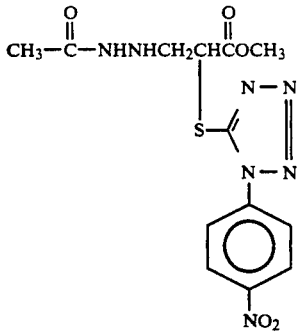
II-14.
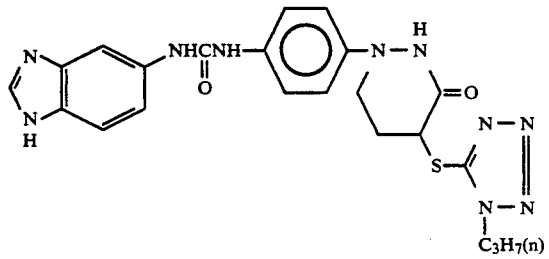
II-15.
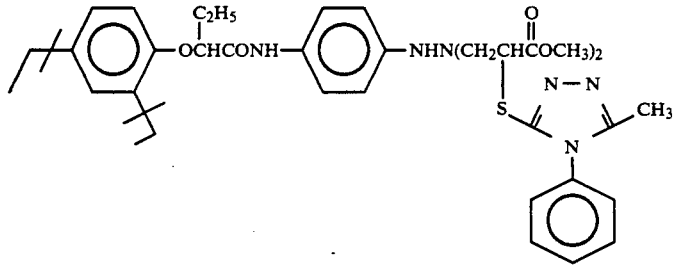
II-16.
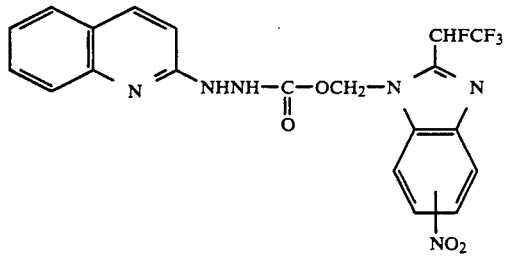
II-17.
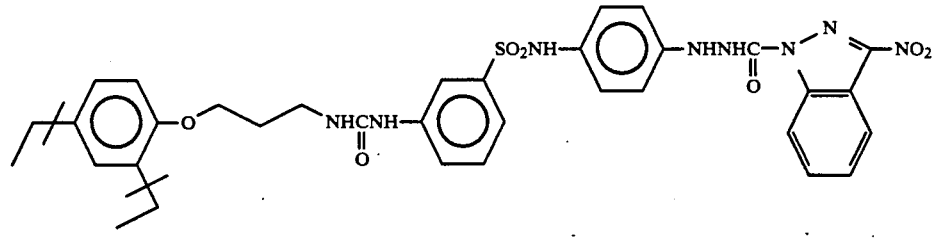
II-18.
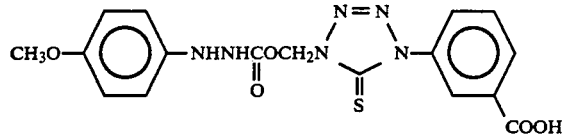

-continued
II-19.
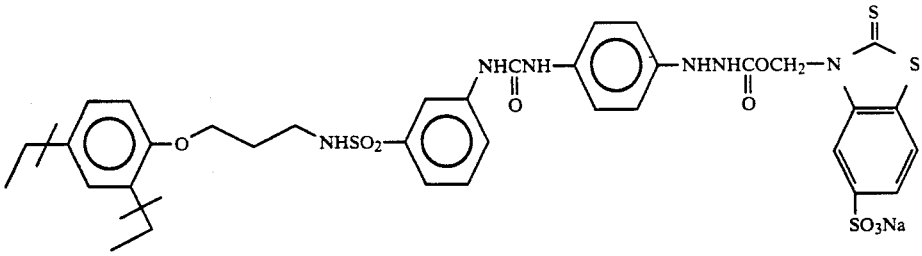
II-20.
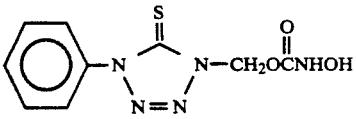
II-21.
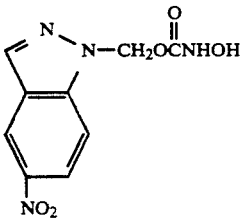
II-22.
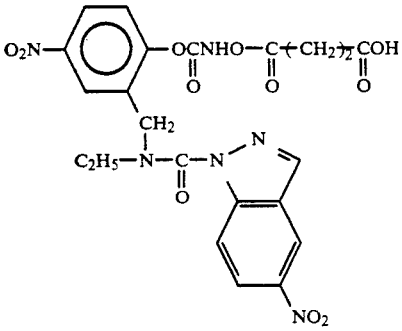
II-23.
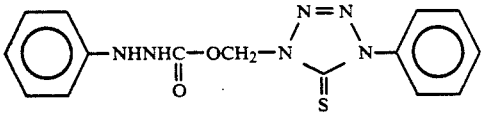
II-24.
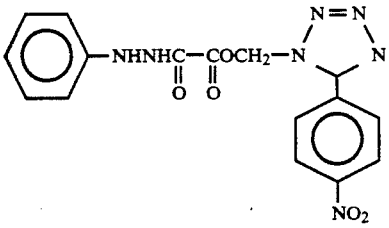
II-25.
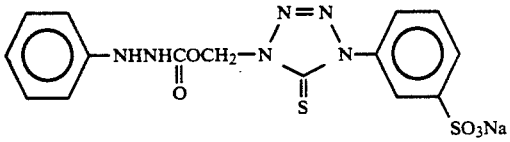

-continued
II-26.
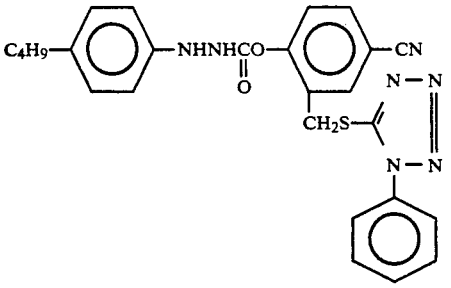
II-27.
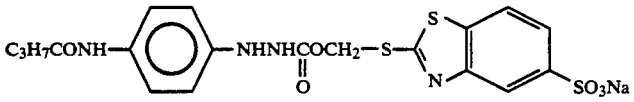
II-28.
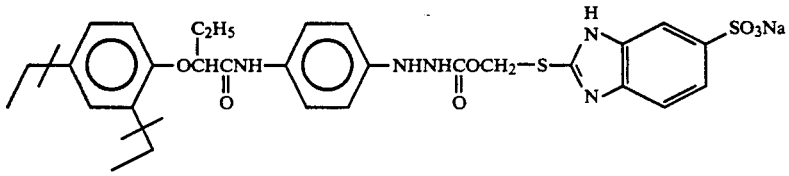
II-29.
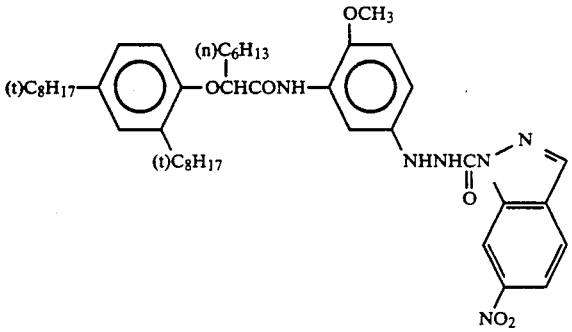
II-30.
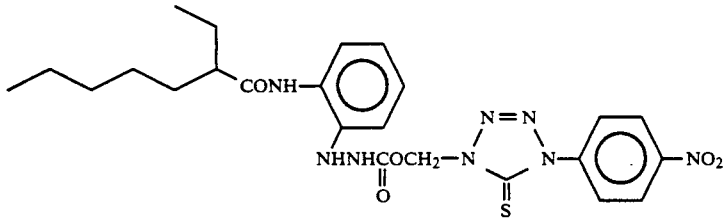
II-31.
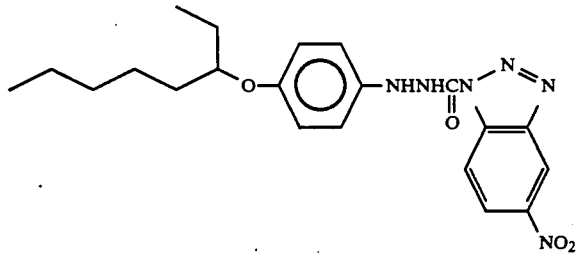
II-32.
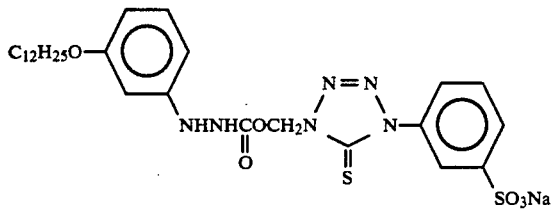

-continued
II-33.
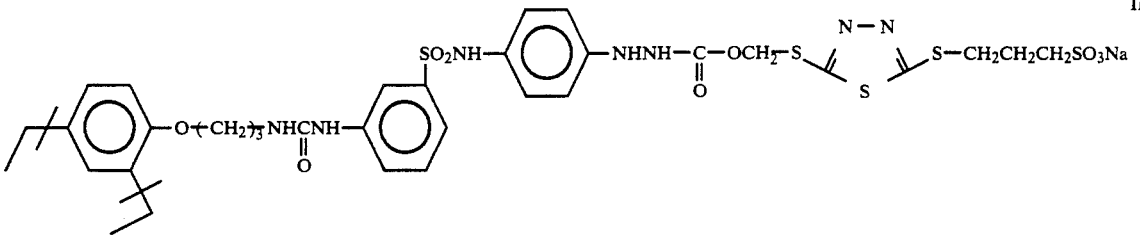
II-34.
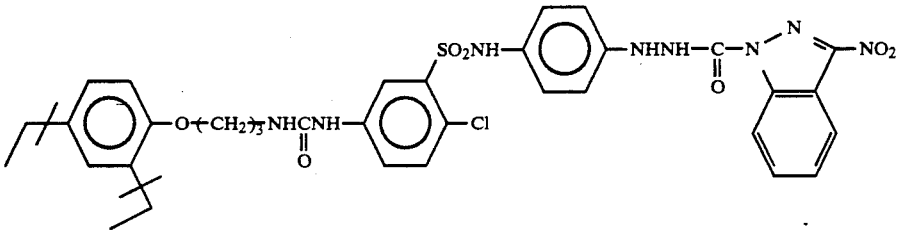
II-35.
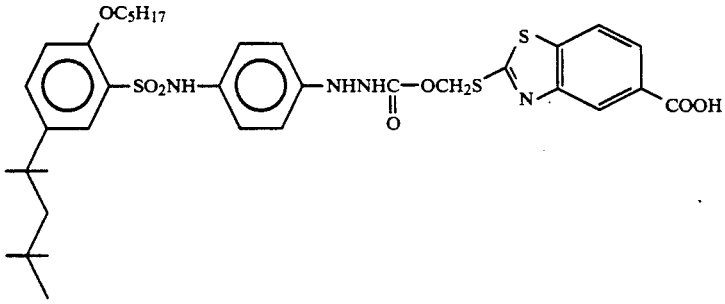
II-36.
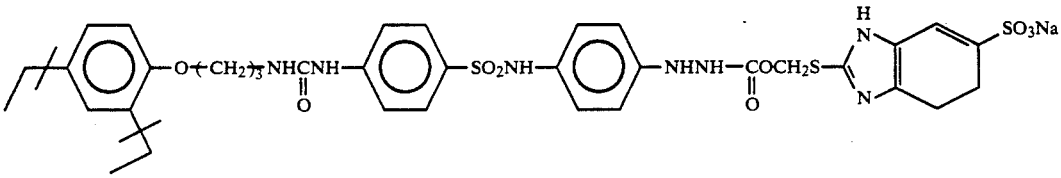
II-37.
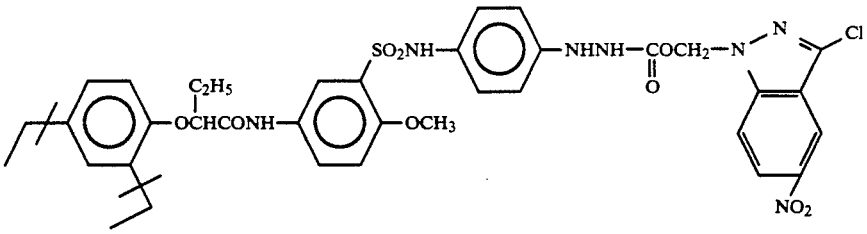
II-38.
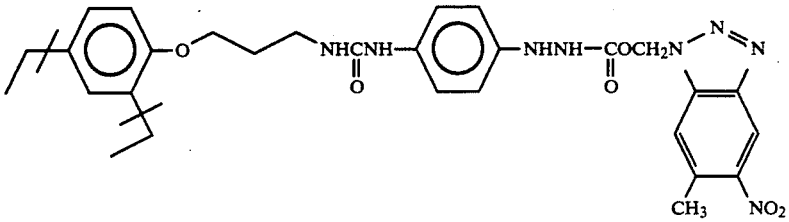

-continued
II-39.
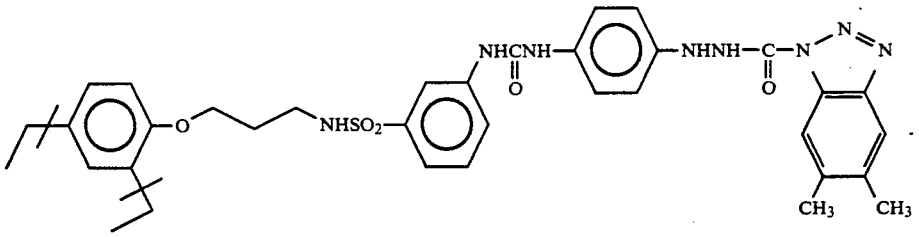
II-40.
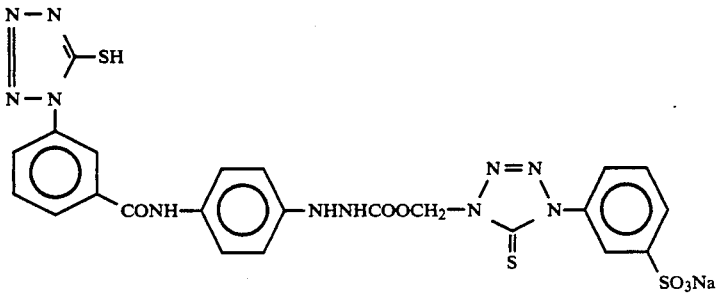
II-41.
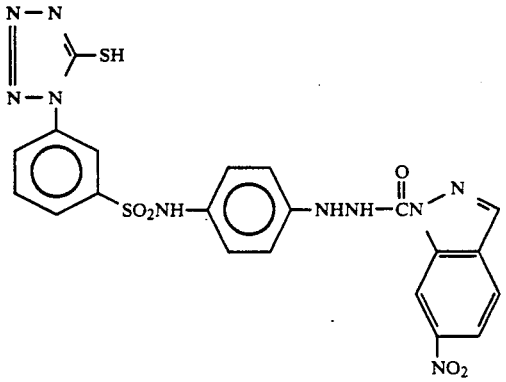
II-42.
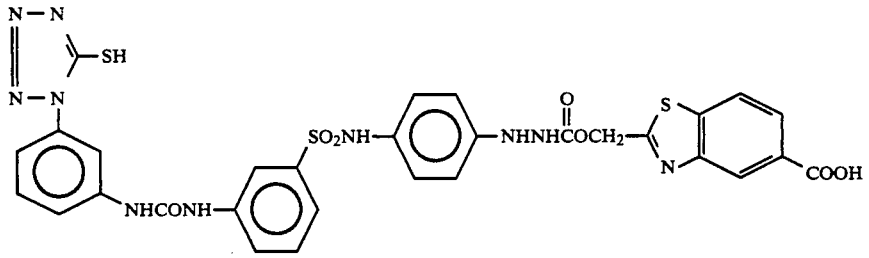
II-43.
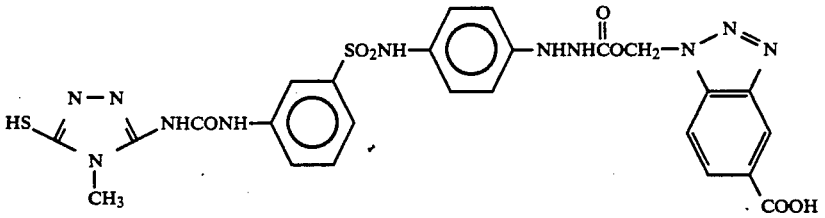
II-44.
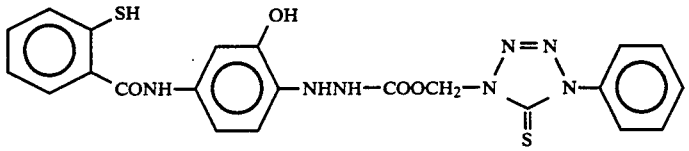

-continued
II-45.
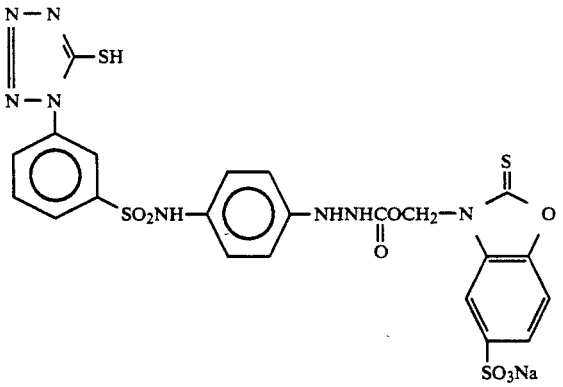
II-46.
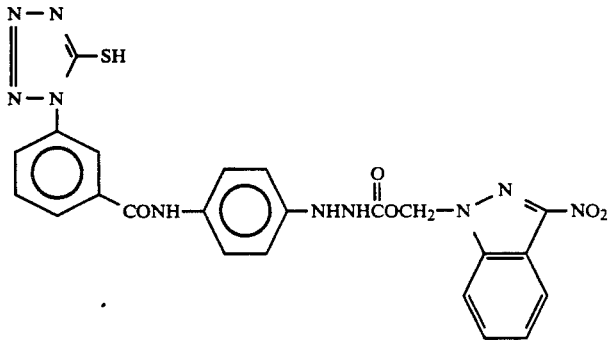
II-47.
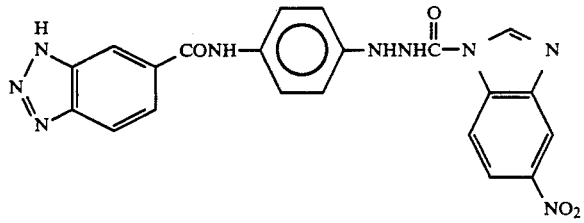
II-48.
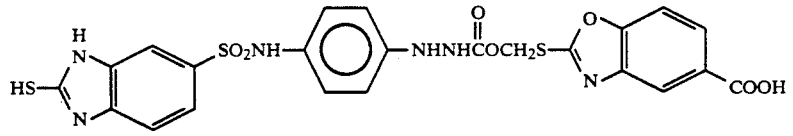
II-49.
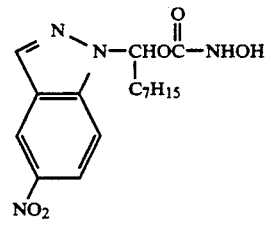
II-50.
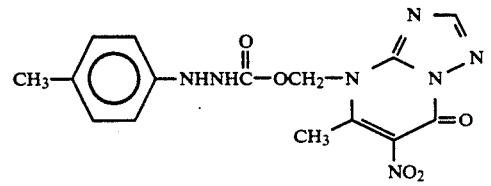

-continued
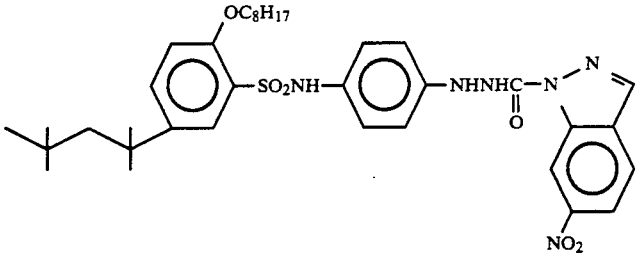
II-51
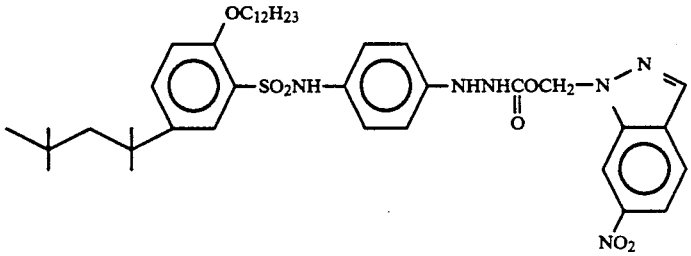
II-52
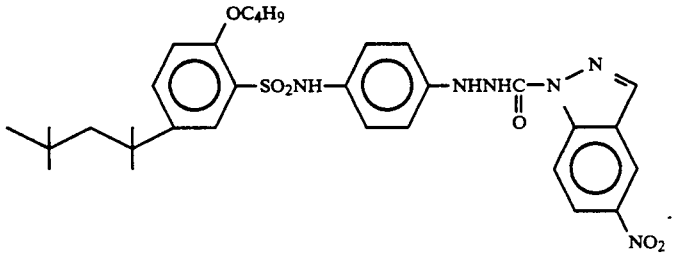
II-53
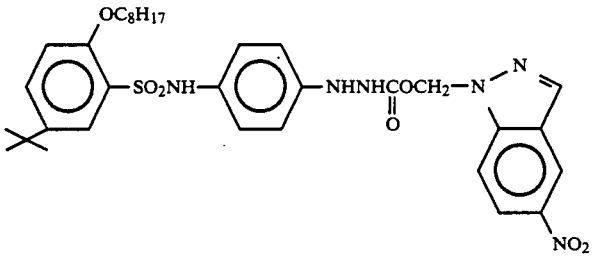
II-54
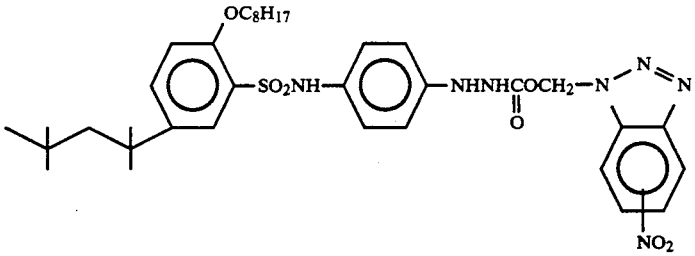
II-55
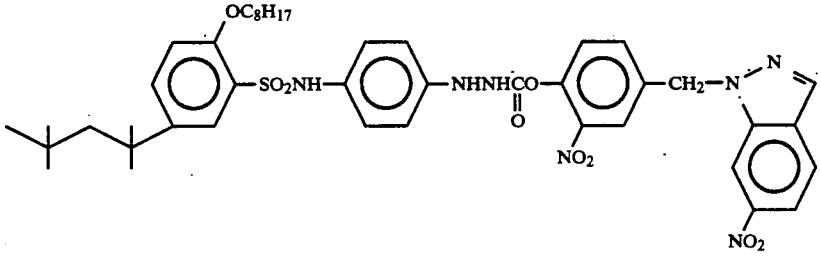
II-56

-continued

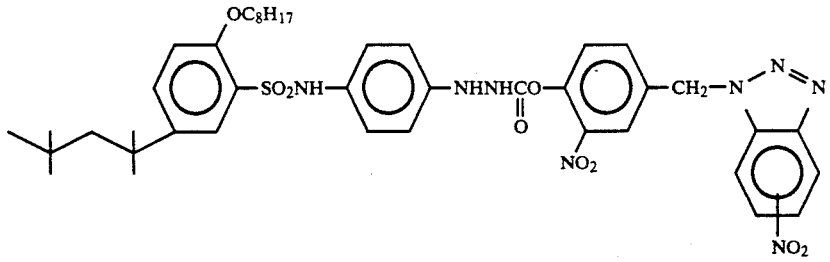

II-57

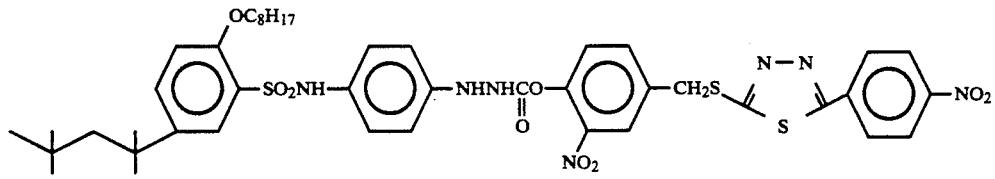

II-58

Methods for synthesis of the redox compounds used in the present invention are described, for example in JP-A-61-213847, JP-A-62-260153, U.S. Pat. No. 4,684,604, Japanese Patent Application No. 63-98803 (corresponding to JP-A-1-269936), U.S. Pat. Nos. 3,379,529, 3,620,746, 4,377,634 and 4,332,878, JP-A-49-129536, JP-A-56-153336, and JP-A-56-153342.

The redox compound according to the present invention is generally employed in a range of from $1.0\times10^{-6}$ mol to $5.0\times10^{-2}$ mol, and preferably from $1.0\times10^{-5}$ mol to $1.0\times10^{-2}$ mol, per mol of silver halide.

The redox compound according to the present invention can be employed by dissolving it in an appropriate water-miscible organic solvent, for example, an alcohol (e.g., methanol, ethanol, propanol, or a fluorinated alcohol), a ketone (e.g., acetone, or methyl ethyl ketone), dimethylformamide, dimethylsulfoxide, or methyl cellosolve.

Also, it can be employed by dissolving it in an oil such as dibutyl phthalate, tricresyl phosphate, glycerol triacetate, or diethylphthalate together with an auxiliary solvent such as ethyl acetate, or cyclohexanone and dispersing it mechanically to form an emulsified dispersion according to an emulsified dispersion method well known in the art. Further, the powdered redox compound can be employed by dispersing in water using a ball mill, a colloid mill or ultrasound according to solid dispersion methods known in the art.

Gelatin is advantageously employed as a binder or a protective colloid in photographic emulsions. Other hydrophilic colloids may also be used. Examples of usable hydrophilic colloids include proteins, e.g., gelatin derivatives, graft polymers of gelatin with other polymers, albumin, and casein; cellulose derivatives, e.g., hydroxyethyl cellulose, carboxymethyl cellulose, and cellulose sulfate; sugar derivatives, e.g., sodium alginate, and starch derivatives; and a wide variety of synthetic hydrophilic high-molecular substances, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and copolymers comprising monomers constituting these homopolymers.

The gelatin used includes not only lime-processed gelatin but acid-processed gelatin, hydrolysis products of gelatin, and enzymatic decomposition products of gelatin.

In the present invention, sensitizing dyes (for example, cyanine dyes, and merocyanine dyes) having their absorption maxima in the visible region as described in JP-A-55-52050, pages 45 to 53, can be employed in addition to the compound represented by formula (A). By the addition of such sensitizing dyes, the silver halide emulsion can be spectrally sensitized in a longer range side than the inherent sensitivity range of silver halide.

These sensitizing dyes can be used singly or in combination thereof, and a combination of sensitizing dyes is frequently used for the purpose of super-sensitization.

The silver halide emulsion for use in the present invention may contain a dye which has no spectral sensitizing action by itself, but the dye exhibits supersensitizing effect together with the sensitizing dye(s), or a substance which does not substantially absorb visible light, but the substance exhibits supersensitizing effect together with the sensitizing dye(s).

Sensitizing dyes, combinations of dyes showing supersensitization, and substances providing supersensitization for use in the present invention are described in *Research Disclosure,* Vol. 176, No. 17643, pages 23, IV-J (December, 1978).

The silver halide photographic material of the present invention may contain various compounds for inhibiting the formation of fog during the production, storage, and processing of the photographic light-sensitive material or for stabilizing the photographic performance thereof. That is, the light-sensitive material may contain various antifoggants and/or stabilizers such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles); mercaptopyrimidines; mercaptotriazines; thioketo compounds (e.g., oxazolinethione), azaindenes [e.g., triazaindene, tetraazaindenes (in particular, 4-hydroxy-substituted (1,3,3a,7)tetraazaindenes), and pentaazaindenes]; benzenethiosulfonic acid; benzenesulfinic acid; and benzenesulfonic acid amide. Among them, benzotriazoles (e.g., 5-methylbenzotriazole) and nitroindazoles (e.g., 5-nitroindazole) are preferred. These compounds may also be incorporated into a processing solution. Further, compounds capable of releasing a development inhibitor during development as described in JP-A-62-30243 may be incorporated into the photographic material as stabilizers or for the purpose of preventing black pepper.

Developing agents, for example, hydroquinone derivatives, and phenidone derivatives may be incorporated into the photographic light-sensitive material of the present invention as stabilizers, accelerators, or for other various purposes.

Also, the photographic light-sensitive material of the present invention may contain inorganic or organic hardening agents in the photographic emulsion layers and other hydrophilic colloid layers.

Specific examples of the hardening agents for use in the present invention include chromium salts (e.g., chromium alum, and chromium acetate), aldehydes (e.g., formaldehyde, and glutaraldehyde), N-methylol compounds (e.g., dimethylolurea), dioxane derivatives, active vinyl compounds (e.g., 1,3,5-triacryloylhexahydro-s-triazine, and 1,3-divinylsulfonyl-2-propanol), active halogen compounds (e.g., 2,4-dichloro-6-hydroxy-s-triazine), mucohalogenic acids (e.g., mucochloric acid). The hardening agents can be used singly or in combination thereof.

The photographic light-sensitive material of the present invention may further contain in the photographic emulsion layers or other hydrophilic colloid layers various surface active agents as coating aids, for static prevention, the improvement of slidability, emulsification and dispersion aids, to prevent adhesion, and to enhance photographic characteristics (e.g., development acceleration and the increase of contrast and sensitivity).

Examples of surface active agents for use in the present invention include nonionic surface active agents such as saponin (steroid series), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride and alkylphenol polyglyceride), fatty acid esters of polyhydric alcohols, etc.; anionic surface active agents having acid groups (e.g., a carboxy group, a sulfo group, a phospho group, a sulfuric acid ester group, and a phosphoric acid ester group), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers, polyoxyethylene alkylphosphoric acid esters; amphoteric surface active agents such as amino acids, aminoalkylsulfonic acids, aminoalkylsulfuric acid esters, aminoalkylphosphoric acid esters, alkylbetaines, and amine oxides; and cationic surface active agents such as alkylamine salts, aliphatic quaternary ammonium salts, aromatic quaternary ammonium salts, heterocyclic quaternary ammonium salts (e.g., pyridiums and imidazoliums), aliphatic phosphonium salts, aliphatic sulfonium salts, phosphonium salts or sulfonium salts containing a heterocyclic ring.

Polyalkylene oxides having a molecular weight of 600 or more as described in JP-B-58-9412 are particularly preferably employed as surface active agents in the present invention.

Also, for static prevention, fluorine-containing surface active agents as described, for example, in JP-A-60-80849 are preferably used.

The photographic light-sensitive material of the present invention may contain in the photographic emulsion layers or other hydrophilic colloid layers hydroquinone derivatives (so-called DIR hydroquinones) which release a development inhibitor corresponding to density of an image at development. Specific examples of the DIR hydroquinones include compounds as described, for example, in U.S. Pat. Nos. 3,379,529, 3,620,746, 4,377,634 and 4,332,878, JP-A-49-129536, JP-A-54-67419, JP-A-56-153336, JP-A-56-153342, JP-A-59-278853, JP-A-59-90435, JP-A-59-90436, and JP-A-59-138808.

The photographic light-sensitive material of the present invention can contain a matting agent such as silica, magnesium oxide, or polymethyl methacrylate in the photographic emulsion layers or other hydrophilic colloid layers to prevent adhesion.

The photographic light-sensitive material of the present invention can contain a dispersion of a water-insoluble or water sparingly soluble synthetic polymer to enhance dimensional stability. Examples thereof include polymers composed of an alkyl (meth)acrylate, an alkoxyacryl (meth)acrylate, or a glycidyl (meth)acrylate, singly or in combination thereof or polymers composed of this monomer and other monomers such as acrylic acid, or methacrylic acid.

The photographic light-sensitive material of the present invention can preferably contain in the silver halide emulsion layers or other layers a compound having an acid group. Suitable examples of the compounds having an acid group include an organic acid such as salicylic acid, acetic acid, or ascorbic acid, and a polymer or copolymer having as a repeating unit an acid monomer such as acrylic acid, maleic acid, or phthalic acid. Details of these compounds are described in JP-A-61-223834, JP-A-61-228437, JP-A-62-25745 and JP-A-62-55642. Of these compounds, those particularly preferred are ascorbic acid as a low molecular weight compound and an aqueous latex dispersion of a copolymer composed of an acid monomer such as acrylic acid and a crosslinkable monomer having two or more unsaturated groups such as divinyl benzene as a high molecular compound.

The emulsion used in the present invention is coated on an appropriate support, for example, glass, a cellulose acetate film, a polyethylene terephthalate film, paper, baryta-coated paper, or polyolefin-coated paper.

In order to obtain photographic characteristics of ultrahigh contrast and high sensitivity using the silver halide photographic material of the present invention, it is not necessary to employ a conventional infectious developing solution or a highly alkaline developing solution having a pH of nearly 13 as described in U.S. Pat. No. 2,419,975, but instead it is possible to use a stable developing solution. More specifically, the silver halide photographic material of the present invention can provide a negative image of ultrahigh contrast using a developing solution having as a preservative a sulfite ion concentration of 0.15 mol/liter or more and a pH of from 10.5 to 12.3, particularly from 11.0 to 12.0.

There is no particular restriction on the developing agent for use in the developing solution according to the present invention, but the dihydroxybenzenes are preferred for obtaining good dot image quality. A combination of a dihydroxybenzene and a 1-phenyl-3-pyrazolidone or a combination of a dihydroxybenzene and a p-aminophenol can be also used as the developing agent.

Examples of the dihydroxybenzene developing agents for use in processing the photographic material of the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Among them, hydroquinone is particularly preferred.

Examples of the 1-phenyl-3-pyrazolidone or the derivatives thereof used as the developing agent in the present invention include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of the p-aminophenol series developing agents used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

The developing agent is ordinarily used in an amount of from 0.05 mol/liter to 0.8 mol/liter. Also, when a combination of a dihydroxybenzene and a 1-phenyl-3-pyrazolidone or a p-aminophenol is used, the former is preferably used in an amount of from 0.05 mol/liter to 0.5 mol/liter and the later in an amount of not more than 0.06 mol/liter.

Examples of sulfites used as preservatives in the present invention include sodium sulfite, potassium sulfite, lithium sulfite, ammonium sulfite, sodium hydrogensulfite, potassium meta-hydrogensulfite, and sodium formaldehyde hydrogensulfite. The amount of the sulfite in the developing solution is at least 0.15 mol/liter, and preferably at least 0.5 mol/liter. Also, the upper limit of the sulfite is preferably 2.5 mol/liter.

For adjusting the pH of the developing solution, pH adjusting agents or buffers such as sodium hydroxide, potassium hydroxide, sodium carbonate, potassium carbonate, sodium tertiary phosphate, and potassium tertiary phosphate can be employed.

The pH of the developing solution is adjusted in a range of from 10.5 to 12.3.

The developing solution for use in the present invention may further contain other additives, for example, compounds such as boric acid, and borax, development inhibitors (e.g., sodium bromide, potassium bromide, and potassium iodide), organic solvents (e.g., ethylene glycol, diethylene glycol, triethylene glycol, dimethylformamide, methyl cellosolve, hexylene glycol, ethanol, and methanol), antifoggants or black pepper preventing agents such as 1-phenyl-5-mercaptotetrazole, indazole series compounds (e.g., 5-nitroindazole), and benzotriazole series compounds (e.g., 5-methylbenzotriazole). Furthermore, if necessary, the developing solution may contain a toning agent, a surface active agent, a defoaming agent, a water softener, a hardening agent, and an amino compound as described in JP-A-56-106244.

Also, the developing solution for use in processing the silver halide photographic material of the present invention may contain the compound described in JP-A-56-24327 as a silver stain inhibitor, the compound described in Japanese Patent Application No. 60-109743 (corresponding to JP-A-61-267759) as a dissolution aid, and the compound described in JP-A-60-93433 or Japanese Patent Application No. 61-28708 (corresponding to JP-A-62-186259) as a pH buffer.

The fixing solution for use in processing the silver halide photographic material of the present invention is one conventionally employed. As the fixing agent, a thiosulfate, a thiocyanate or an organic sulfur compound which is effectively employed as a fixing agent can be used. The fixing solution may contain as a hardening agent a water-soluble aluminium salt (e.g., aluminium sulfate, or alum). The amount of the water-soluble aluminium salt is usually from 0.4 g to 2.0 g per liter based on aluminium.

Further, a trivalent iron compound may be used in the form of a complex of ethylenediaminetetraacetic acid as an oxidizing agent.

The temperature of development processing of the photographic material of the present invention is ordinarily from 18° C. to 50° C., and preferably from 25° C. to 43° C.

The present invention is now illustrated in greater detail with reference to the following examples, but the present invention is not to be construed as being limited thereto. Unless otherwise indicated, all parts, percents and ratios are by weight.

In the examples, a developing solution having the following composition was used.

| Developing Solution: | |
|---|---|
| Hydroquinone | 45.0 g |
| N-Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1 l |
| | (pH 11.6) |

EXAMPLE 1

Emulsions a to d were prepared in the manner described below.

Emulsion a

To an aqueous gelatin solution containing 1,8-dihydroxy-3,6-dithiaoctane, a mixed aqueous solution of potassium iodide and potassium bromide and an aqueous solution of silver nitrate were added with vigorous stirring over a period of 15 minutes at 75° C. while controlling the pAg at 8.0 to provide a monodisperse octahedral silver iodobromide emulsion having a mean grain size of 0.22 μm and an iodide content of 6 mol %. This emulsion served as the core material.

To the above silver iodobromide core emulsion, an aqueous potassium bromide solution containing $10^{-7}$ mol of $K_3IrCl_6$ per mol of Ag and an aqueous silver nitrate solution were added such that the pAg thereof became 7.4, to provide a core/shell silver iodobromide emulsion.

After removing the soluble salts from the emulsion, to the emulsion was added $2\times10^{-4}$ mol of Sensitizing Dye A-25) per mol of silver, and the emulsion was chemically sensitized over a period of 70 minutes at 65° C. by adding $1.9\times10^{-5}$ mol of sodium thiosulfate and $1.2\times10^{-5}$ mol of chloroauric acid per mol of silver. Thereafter, a 1% aqueous solution of 4-hydroxy-6-methyl-1,3,3a,7-tetraazaindene was added to the emulsion as a stabilizer in an amount of 30 ml per mol of silver, and then proxcel was added thereto as an antiseptic.

A monodisperse silver iodobromide emulsion having a mean silver iodide content of 1.5 mol % and a mean grain size of 0.40 μm (coefficient of variation: 10%) was thereby obtained.

Emulsion b

The same procedure for preparing Emulsion a was conducted except for forming a monodisperse octahedral silver iodobromide emulsion having a mean grain size of 0.22 μm and an iodide content of 4 mol % as a core material, whereby a monodisperse silver halide emulsion having a mean silver iodide content of 1.0 mol % and a mean grain size of 0.40 μm (coefficient of variation: 9%) was obtained.

Emulsion c

A mixed aqueous solution of potassium iodide and potassium bromide and an aqueous silver nitrate solution were added to an aqueous gelatin solution containing 1,8-dihydroxy-3,6-dithiaoctane with vigorous stirring for a period of 15 minutes at 75° C. while controlling the pAg to 8.0 to provide a monodisperse octahedral silver iodobromide emulsion having a mean grain size of 0.20 μm and a iodide content of 4 mol %. This emulsion served as a core material.

Then, by adding an aqueous potassium bromide solution containing $10^{-7}$ mol of $K_3IrCl_6$ per mol of Ag and an aqueous silver nitrate solution to the above-described silver iodobromide core emulsion such that the pAg became 7.4, a core/shell silver iodobromide emulsion was thereby obtained.

After removing soluble salts from the emulsion, $2\times10^{-4}$ mol of Sensitizing Dye A-25) per mol of silver was added to the emulsion at 50° C., and then a previously prepared silver iodide emulsion having a grain size of 0.04 μm in an amount corresponding to $5\times10^{-3}$ mol per mol of silver in the total grains was added thereto. After stirring for 10 minutes, $1.9\times10^{-5}$ mol of sodium thiosulfate and $1.2\times10^{-5}$ mol of chloroauric acid per mol of silver were added to the emulsion and the emulsion was chemically-sensitized over a period of 70 minutes at 65° C. Then, 30 ml of an 1% aqueous solution of 4-hydroxy-6-methyl-1,3,3a,7-tetraazaindene per mol of silver was added as a stabilizer to the emulsion, and then proxcel was added thereto as an antiseptic to thereby obtain a monodisperse emulsion having a mean silver iodide content of 1.5 mol % and a mean grain size of 0.40 μm. The coefficient of variation thereof was 9%.

Emulsion d

The same procedure for preparing Emulsion c was conducted except for reducing the amount of 1,8-dihydroxy-3,6-dithiaoctane to prepare a monodisperse octahedral silver iodobromide emulsion having a mean grain size of 0.18 μm and an iodide content of 4 mol % as a core material, whereby a monodisperse emulsion having a mean silver iodide content of 1.5 mol % and a mean grain size of 0.37 μm (coefficient of variation: 9%) was obtained.

Samples 1 to 4 were prepared in the following manner.

To each of the emulsions described above were added 25 mg of 1-phenyl-5-mercaptotetrazole per mol of silver as an antifoggant, 150 mg/m² (after coating) of hydroquinone, 25% by weight based on the weight of the gelatin binder of a polyethyl acrylate latex as a plasticizer, 80 mg/m² (after coating) of 2-bis(vinylsulfonylacetamido)ethane and 40 mg/m² (after coating) of 2,4-dichloro-6-hydroxy-s-triazine as hardening agents. The resulting emulsion was coated on a polyester film support at a silver coverage of 4.5 g/m². The gelatin coverage was 4.7 g/m².

On the above emulsion layer were simultaneously coated an upper protective layer containing 0.7 g/m² of gelatin, 60 mg/m² of polymethyl methacrylate particles having a particle size of from 3 μm to 4 μm and 70 mg/m² of colloidal silica having a particle size of from 10 mμ to 20 mμ as matting agents, 100 mg/m² of a silicone oil, sodium dodecylbenzenesulfonate as a coating aid, proxcel and phenoxyethanol as antiseptics, and 5 mg/m² of a fluorine type surface active agent having the following formula (1):

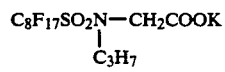

$$C_8F_{17}SO_2\underset{\underset{C_3H_7}{|}}{N}-CH_2COOK \quad (1)$$

and a lower protective layer containing 0.9 g/m² of gelatin, 225 mg/m² of a polyethyl acrylate latex, and 50 mg/m² of sodium dodecylbenzenesulfonate as a coating aid.

The support employed herein had a back layer and a back protective layer of the following compositions. (The back layer and the back protective layer each contains proxcel and phenoxyethanol as antiseptics.)

| Back Layer: | |
|---|---|
| Gelatin | 3.9 g/m² |
| Sodium dodecylbenzenesulfonate | 80 mg/m² |
| Dye (a) | 80 mg/m² |
| Dye (b) | 30 mg/m² |
| Dye (c) | 150 mg/m² |
| 1,3-Divinylsulfonyl-2-propanol | 80 mg/m² |

-continued

| | |
|---|---|
| Potassium polyvinyl-benzenesulfonate | 30 mg/m$^2$ |

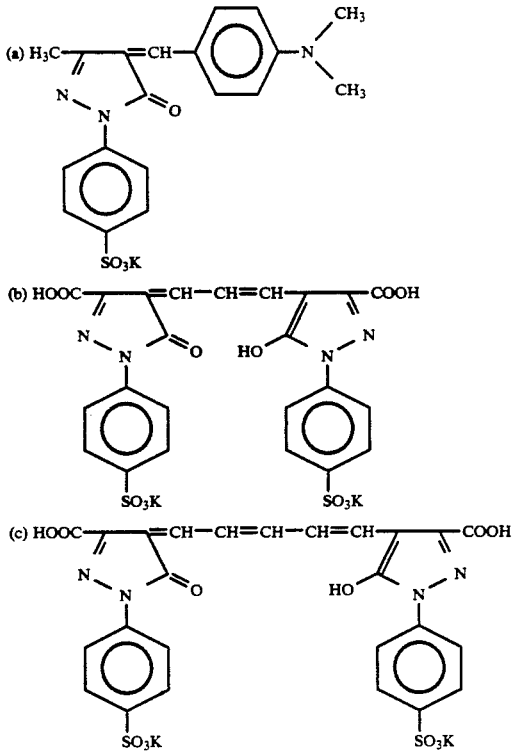

| Back Protective Layer: | |
|---|---|
| Gelatin | 0.75 g/m$^2$ |
| Polymethyl methacrylate particles (particle size 4.7 μm) | 30 mg/m$^2$ |
| Sodium dodecylbenzenesulfonate | 20 mg/m$^2$ |
| Fluorine type surface active agent (Compound (1) shown above) | 2 mg/m$^2$ |
| Silicone oil | 100 mg/m$^2$ |

Samples 1 to 4 thus-prepared were exposed through a wedge using a white light source, and then developed at 34° C. for 30 seconds using the above described developing solution. Sensitivity, $\gamma$ and $D_{max}$ of each developed sample were determined. The results are shown in Table 1 below. The sensitivity is the reciprocal of the exposure amount providing a density of 1.5 and is shown relatively, taking the value of Sample 1 as 100.

As is apparent from the results shown in Table 1, Samples 3 and 4 according to the present invention exhibit excellent performance of high sensitivity, $\gamma$ and $D_{max}$.

TABLE 1

| Sample No. | Emulsion No. | Photographic Characteristics Sensitivity | $\gamma$ | $D_{max}$ | Remark |
|---|---|---|---|---|---|
| 1 | a | 100 | 5.1 | 4.5 | Comparison |
| 2 | b | 98 | 5.2 | 4.7 | Comparison |
| 3 | c | 120 | 6.0 | 5.2 | Present Invention |
| 4 | d | 110 | 6.2 | 5.5 | Present Invention |

EXAMPLE 2

Emulsions A to G were prepared in the manner described below.

Emulsion A

To 800 ml of an aqueous gelatin solution (gelatin concentration: 3.5%) kept at 50° C. were added simultaneously an aqueous solution of silver nitrate and an aqueous solution of potassium bromide in the presence of ammonia over a period of 60 minutes while maintaining the system at a pAg of 7.8 to prepare a monodisperse cubic silver bromide emulsion having a mean grain size of 0.28 μm (coefficient of variation: 10%).

The temperature of the emulsion was decreased to 40° C., the emulsion was desalted by a flocculation method, and then gelatin, an aqueous solution of potassium bromide (pAg being adjusted to 9.0) and phenoxyethanol as an antiseptic were added thereto. Thereafter, the temperature was raised to 50° C., $5\times10^{-4}$ mol of Compound A-13) per mol of silver as a sensitizing dye was added to the emulsion, and after 5 minutes, an aqueous solution of potassium iodide was added in an amount corresponding to $1\times10^{-3}$ mol per mol of silver, then the emulsion was allowed to stand for 10 minutes to be subjected to conversion, followed by decreasing the temperature.

Emulsion B

In the same manner as described for Emulsion A except for adding the potassium iodide solution in an amount corresponding to $5\times10^{-3}$ mol per mol of silver in place of $1\times10^{-3}$ mol per mol of silver in Emulsion A Emulsion B was prepared.

Emulsion C

To 800 ml of an aqueous gelatin solution (gelatin concentration: 3.5%) kept at 50° C. were added simultaneously an aqueous solution of silver nitrate and an aqueous solution of potassium bromide in the presence of ammonia over a period of 60 minutes while maintaining the system at a pAg of 7.8 to prepare a monodisperse cubic silver bromide emulsion having a mean grain size of 0.28 μm (coefficient of variation: 10%).

The temperature of the emulsion was decreased to 40° C., the emulsion was desalted by a flocculation method, and then gelatin, an aqueous solution of potassium bromide (pAg being adjusted to 9.0) and phenoxyethanol as an antiseptic were added thereto. Thereafter, the temperature was raised to 50° C., $5\times10^{-4}$ mol of Compound A-13) per mol of silver as a sensitizing dye was added to the emulsion, and after 5 minutes, an 1% aqueous solution of silver nitrate and an 1% aqueous solution of potassium iodide were simultaneously added each in an amount corresponding to $5\times10^{-3}$ mol per mol of silver in the total grains to be subjected to conversion.

Emulsion D

In the same manner as described for Emulsion C except for adding the aqueous silver nitrate solution and potassium iodide solution each in an amount corresponding to $3\times10^{-2}$ mol per mol of silver in place of $5\times10^{-3}$ mol per mol of silver in Emulsion C, Emulsion D was prepared.

Emulsion E

In the same manner as described in Emulsion C except for adding a previously prepared silver iodide emulsion having a grain size of 0.04 μm in an amount corresponding to $5\times10^{-3}$ mol per mol of silver in place of the simultaneous addition of the aqueous silver nitrate solution and potassium iodide solution (each in an amount corresponding to $5\times10^{-3}$ mol per mol of silver) in Emulsion C, Emulsion E was prepared.

Emulsion F

In the same manner as described in Emulsion E except for adding the silver iodide emulsion in an amount corresponding to $1\times10^{-2}$ mol per mol of silver in place of the amount corresponding to $5\times10^{-3}$ mol per mol of silver in Emulsion E, Emulsion F was prepared.

Emulsion G

In the same manner as described in Emulsion E except for adding the silver iodide emulsion in an amount corresponding to $3\times10^{-2}$ mol per mol of silver in place of the amount corresponding to $5\times10^{-3}$ mol per mol of silver in Emulsion E, Emulsion G was prepared.

The characteristics of Emulsions A to G are illustrated in the following table.

| | Host Grain | | | Conversion | | |
|---|---|---|---|---|---|---|
| Emulsion | Crystal Habit | Size (μm) | Halogen Composition | Method | AgI (mol %) | Remark |
| A | cubic | 0.28 | AgBr | KI alone | 0.1 | Comparison |
| B | cubic | 0.28 | AgBr | KI alone | 0.5 | Comparison |
| C | cubic | 0.28 | AgBr | $AgNO_3$ + KI | 0.5 | Present Invention |
| D | cubic | 0.28 | AgBr | $AgNO_3$ + KI | 3.0 | Comparison |
| E | cubic | 0.28 | AgBr | AgI Grain | 0.5 | Present Invention |
| F | cubic | 0.28 | AgBr | AgI Grain | 1.0 | Present Invention |
| G | cubic | 0.28 | AgBr | AgI Grain | 3.0 | Comparison |

Samples 5 to 11 were prepared in the following manner.

To each of emulsions A-G were added, as stabilizers, 4-hydroxy-6-methyl-1,3,3a,7-tetraazaindene, 5-methylbenzotriazole, and Compounds (a) and (b) shown below each in an amount of 5 mg/m².

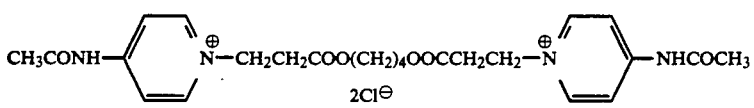

Compound (a)

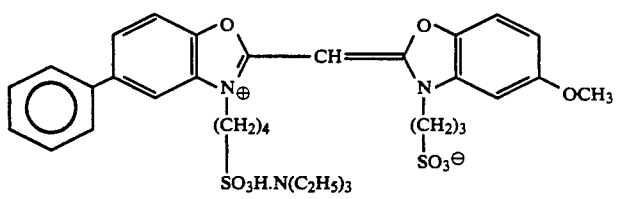

Compound (b)

As hydrazine compounds, $5\times10^{-5}$ mol of Compound I-19) and $1\times10^{-4}$ mol of Compound I-5) were added to the emulsion. Further, 75 mg/m² of polyethylene glycol having an average molecular weight of 600, 30% by weight (on a solid basis), based on gelatin, of a polyethyl acrylate dispersion, and 75 mg/m² of 1,3-divinylsulfonyl-2-propanol as a hardening agent were added to the emulsion. The resulting coating composition was coated on a polyethylene terephthalate film to a silver coverage of 3.5 g/m² to form an emulsion layer. The gelatin coverage was 2 g/m².

A composition comprising 1.2 g/m² of gelatin, 40 mg/m² of an amorphous $SiO_2$ matting agent having a particle size of about 3 μm, 0.1 g/m² of methanol silica, 100 mg/m² of polyacrylamide, 200 mg/m² of hydroquinone, a silicone oil, as antiseptics, proxcel and phenoxyethanol, and, as surface active agents, 5 mg/m² of a fluorine type surface active agent having the following formula:(1)

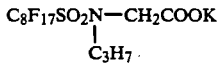

and sodium dodecylbenzenesulfonate, was Simultaneously coated on the emulsion layer to form a protective layer, whereby Samples 5 to 11 as shown in Table 2 below were prepared.

A backing layer having the following composition was coated on the back of the polyethylene terephthalate film support.

| Back Layer Composition: | |
|---|---|
| Gelatin | 4 g/m² |
| Matting agent (polymethyl methacrylate having a particle size of from 3.0 to 4.0 μm) | 10 mg/m² |
| Polyethyl acrylate latex | 2 g/m² |
| Surface active agent (sodium p-dodecylbenzene-sulfonate) | 40 mg/m² |
| Fluorine type surface active agent: | 5 mg/m² |

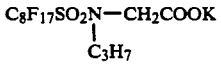

| | |
|---|---|
| Gelatin hardening agent: | 110 mg/m² |

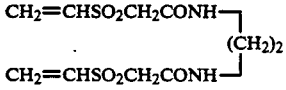

| Dye: a mixture of: | |
|---|---|
| Dye (a) | 50 mg/m² |
| Dye (b) | 100 mg/m² |

-continued

| Dye (c) | 50 mg/m² |
|---|---|

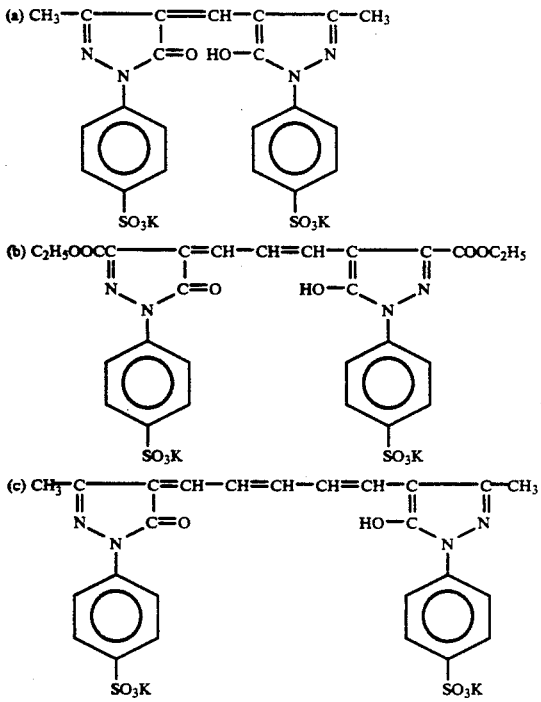

Further, proxcel and phenoxyethanol were added to the coating solution for the backing layer as antiseptics.

The performances of the samples were evaluated according to the following test methods.

TEST METHOD

1. Evaluation of Image Quality in Enlargement (1) Preparation of Original:

A transparent image of a portrait composed of dots and a step wedge having a stepwise varying dot percentage were prepared by using a monochromatic scanner "SCANART 30" and a light-sensitive material for exclusive use "SF-100" (produced by Fuji Photo Film Co., Ltd.). The screen line number was 150 lines/inch.

(2) Exposure:

The above-described original was set in a process camera "C-440" (produced by Dai-Nippon Screen K.K.) so as to obtain an equal enlargement ratio, and a sample to be tested was exposed to light emitted from a xenon lamp through the original.

The exposure amount was adjusted in such a manner that the section of the step wedge having a dot percentage of 95% was 5% on the sample.

(3) Evaluation:

The gradation reproducibility in the shadow of the sample [with the dot percentage in the highlight (small dot area) being adjusted by exposure control as described in (2) above] was rated in five scales (5: the best; 1: the worst).

2. Evaluation of Copy Dot Image Quality (1) Preparation of Original:

A step wedge having a stepwise varying dot percentage was prepared by using a monochromatic scanner "SCANART 30" and an exclusive paper "SP-100 WP" (produced by Fuji Photo Film Co., Ltd.). The screen line number at the exposure was 150 lines/inch.

(2) Exposure

The original and a sample under test were set in a process camera "C-690: (Auto Companica) (manufactured by Dai-Nippon Screen K.K.), and light of a xenon lamp was irradiated to the reflex original.

The exposure time was adjusted so that the section of the step wedge having a dot percentage of 80% was 10% on the sample.

(3) Evaluation

The gradation reproducibility in the shadow of the exposed sample [with the dot percentage in the highlight being adjusted to 10% by exposure time control as described in (2) above] was relatively evaluated, rating the best as 5 and the worst as 1.

The samples were exposed to a xenon light source and then processed using a developing solution GR-D1 (produced by Fuji Photo Film Co., Ltd.), a fixing solution GR-F1 (produced by Fuji Photo Film Co., Ltd.) for 30 seconds at 34° C. with an automatic developing machine FG-660F (produced by Fuji Photo Film Co., Ltd.) to evaluate the enlargement image quality and the copy dot image quality.

The sensitivity was the reciprocal of the exposure amount providing a density of 1.5 and shown relatively taking the value of Sample 5 developed at 34° C. for 30 seconds as 100. The $D_{max}$ was expressed by a density corresponding to $D_{max}$ of the practical use (density of the point on the characteristic curve where a logarithmic valve of the exposure amount is that of sensitivity point providing a density of 0.1 plus 0.5)

TABLE 2

| Sample No. | Emulsion No. | Photographic Characteristics Sensitivity | γ | $D_{max}$ | Black Pepper | Enlargement Image Quality | Copy Dot Image Quality | Remark |
|---|---|---|---|---|---|---|---|---|
| 5 | A | 100 | 11.5 | 4.2 | 5 | 2 | 2 | Comparison |
| 6 | B | 117 | 13.8 | 4.4 | 5 | 2 | 2 | Comparison |
| 7 | C | 126 | 16.8 | 5.0 | 5 | 4 | 4 | Present Invention |
| 8 | D | 148 | 18.0 | 5.0 | 2 | 3 | 3 | Comparison |
| 9 | E | 129 | 16.8 | 5.2 | 5 | 4 | 4 | Present Invention |
| 10 | F | 132 | 17.0 | 5.2 | 5 | 4 | 4 | Present Invention |
| 11 | G | 154 | 18.1 | 5.0 | 2 | 3 | 3 | Comparison |

As is apparent from the results shown in Table 2, Samples 7, 9 and 10 according to the present invention exhibited excellent photographic characteristics, excellent enlargement image quality and excellent copy dot image quality.

EXAMPLE 3

Emulsions H to N were prepared in the manner described below.

Emulsion H

To 800 ml of an aqueous gelatin solution (gelatin concentration: 3.5%) kept at 50° C. were added simultaneously an aqueous solution of silver nitrate and an aqueous solution of potassium iodide and potassium bromide containing $4\times10^{-7}$ mol of $K_3IrCl_6$ per mol of silver in the presence of ammonia over a period of 60 minutes while maintaining the system at a pAg of 7.8 to prepare a monodisperse cubic silver iodobromide emulsion having a mean grain size of 0.28 μm and an iodide content of 0.5 mol % (coefficient of variation: 10%).

The temperature of the emulsion was decreased to 40° C., the emulsion was desalted by a flocculation method, and then gelatin, an aqueous solution of potassium bromide (pAg being adjusted to 9.0) and phenoxyethanol as an antiseptic were added thereto. Thereafter, the temperature was raised to 50° C., $5\times10^{-4}$ mol of Compound A-13) per mol of silver as a sensitizing dye was added to the emulsion, and after 5 minutes, an aqueous solution of potassium iodide was added in an amount corresponding to $1\times10^{-3}$ mol per mol of silver, then the emulsion was allowed to stand for 10 minutes to be subjected to conversion, followed by decreasing the temperature. (total silver iodide content: 0.6 mol %).

Emulsion I

In the same manner as described for Emulsion H except for adding the potassium iodide solution in an amount corresponding to $5\times10^{-3}$ mol per mol of silver in place of $1\times10^{-3}$ mol per mol of silver in Emulsion H, Emulsion I was prepared. (total silver iodide content: 1.0 mol %).

Emulsion J

In the same manner as described in Emulsion H except for adding a previously prepared silver iodide emulsion having a grain size of 0.04 μm in an amount corresponding to $5\times10^{-3}$ mol per mol of silver in place of the addition of the aqueous potassium iodide solution (in an amount corresponding to $1\times10^{-3}$ mol per mol of silver in Emulsion H), Emulsion J was prepared. (total silver iodide content: 1.0 mol %).

Emulsion K method, and then gelatin, an aqueous solution of potassium bromide (pAg being adjusted to 9.0) and phenoxyethanol as an antiseptic were added thereto. Thereafter, the temperature was raised to 50° C., $5\times10^{-4}$ mol of Compound A-13) per mol of silver as a sensitizing dye was added to the emulsion, and after 5 minutes, an aqueous solution of potassium iodide was added in an amount corresponding to $1\times10^{-3}$ mol per mol of silver, then the emulsion was allowed to stand for 10 minutes to be subjected to conversion, followed by decreasing the temperature.

Emulsion L

In the same manner as described for Emulsion K except for adding the potassium iodide solution in an amount corresponding to $5\times10^{-3}$ mol per mol of silver, in place of $1\times10^{-3}$ mol per mol of silver in Emulsion K, Emulsion L was prepared. (total silver iodide content: 0.5 mol %)

Emulsion M

In the same manner as described in Emulsion K except for adding a previously prepared silver iodide emulsion having a grain size of 0.04 μm in an amount corresponding to $1\times10^{-3}$ mol per mol of silver in place of the addition of the aqueous potassium iodide solution (in an amount corresponding to $1\times10^{-3}$ mol per mol of silver in Emulsion K), Emulsion M was prepared. (total silver iodide content: 0.1 mol %)

Emulsion N

In the same manner as described in Emulsion K except for adding a previously prepared silver iodide emulsion having a grain size of 0.04 μm in an amount corresponding to $5\times10^{-3}$ mol per mol of silver in place of the addition of the aqueous potassium iodide solution (in an amount corresponding to $1\times10^{-3}$ mol per mol of silver in Emulsion K), Emulsion N was prepared. (total silver iodide content: 0.5 mol %)

The characteristics of Emulsions H to N are illustrated in the following table.

| | Host Grain | | | Conversion | | |
|---|---|---|---|---|---|---|
| Emulsion | Crystal Habit | Size (μm) | Halogen Composition | Method | AgI (mol %) | Remark |
| H | cubic | 0.27 | AgBr: 99.5, AgI: 0.5 | KI alone | 0.1 | Comparison |
| I | cubic | 0.27 | AgBr: 99.5, AgI: 0.5 | KI alone | 0.5 | Comparison |
| J | cubic | 0.27 | AgBr: 99.5, AgI: 0.5 | AgI Grain | 0.5 | Present Invention |
| K | Tetradecahedral | 0.3 | AgBr | KI alone | 0.1 | Comparison |
| L | Tetradecahedral | 0.3 | AgBr | KI alone | 0.5 | Comparison |
| M | Tetradecahedral | 0.3 | AgBr | AgI Grain | 0.1 | Comparison |
| N | Tetradecahedral | 0.3 | AgBr | AgI Grain | 0.5 | Present Invention |

To 800 ml of an aqueous gelatin solution (gelatin concentration: 3.5%) kept at 50° C. were added simultaneously an aqueous solution of silver nitrate and an aqueous solution of potassium bromide in the presence of ammonia over a period of 60 minutes while maintaining the system at a pAg of 8.2 to prepare a monodisperse tetradecahedral silver bromide emulsion having a mean grain size of 0.3 μm (coefficient of variation: 10%)

The temperature of the emulsion was decreased to 40° C., the emulsion was desalted by a flocculation Using these emulsions Samples 12 to 18 as shown in Table 3 below were prepared in accordance with the same procedure as described in Example 2, respectively. These samples were subjected to the same evaluations as described in Example 2. The results obtained are shown in Table 3 below.

As is apparent from the results shown in Table 3, Samples 14 and 18 according to the present invention exhibited high sensitivity and $D_{max}$ and excellent image quality.

TABLE 3

| Sample No. | Emulsion No. | Photographic Characteristics Sensitivity | γ | $D_{max}$ | Black Pepper | Enlargement Image Quality | Copy dot Image Quality | Remark |
|---|---|---|---|---|---|---|---|---|
| 12 | H | 100 | 16.9 | 5.2 | 4 | 1 | 1 | Comparison |
| 13 | I | 110 | 16.0 | 5.0 | 3 | 2 | 2 | Comparison |
| 14 | J | 120 | 16.8 | 5.2 | 4 | 4 | 4 | Present Invention |
| 15 | K | 81 | 11.8 | 4.3 | 5 | 3 | 3 | Comparison |
| 16 | L | 87 | 12.9 | 4.4 | 5 | 3 | 3 | Comparison |
| 17 | M | 89 | 13.0 | 4.5 | 5 | 3 | 3 | Comparison |
| 18 | N | 100 | 17.0 | 5.2 | 5 | 4 | 4 | Present Invention |

EXAMPLE 4

Samples 19 to 36 were prepared by adding the following compounds represented by formula (II) according to the present invention and the same compounds as described in Example 2 to Emulsions C and E used in Example 2 and coating, respectively. These samples were subjected to the same evaluations as described in Example 2. The results obtained are shown in Table 4 below.

As is apparent from the results shown in Table 4, by the use of the compound represented by formula (II) according to the present invention the image qualities were further improved (Samples 20 to 27 and 29 to 36).

TABLE 4

| Sample No. | Emulsion | Compound of Formula (II) | Amount Added (mol/mol Ag) | Photographic Characteristics Sensitivity | γ | $D_{max}$ | Black Pepper | Enlargement Image Quality | Copy Dot Image Quality |
|---|---|---|---|---|---|---|---|---|---|
| 19 | C | — | — | 100 | 16.5 | 5.0 | 5 | 4 | 4 |
| 20 | C | II-17 | $5 \times 10^{-5}$ | 100 | 16.0 | 5.0 | 5 | 5 | 5 |
| 21 | C | II-17 | $1 \times 10^{-4}$ | 95 | 15.5 | 5.0 | 5 | 5 | 5 |
| 22 | C | II-31 | $5 \times 10^{-5}$ | 98 | 16.0 | 4.9 | 5 | 5 | 5 |
| 23 | C | II-31 | $1 \times 10^{-4}$ | 95 | 15.6 | 4.9 | 5 | 5 | 5 |
| 24 | C | II-41 | $5 \times 10^{-5}$ | 98 | 16.0 | 5.0 | 5 | 5 | 5 |
| 25 | C | II-41 | $1 \times 10^{-4}$ | 95 | 15.8 | 4.9 | 5 | 5 | 5 |
| 26 | C | II-51 | $5 \times 10^{-5}$ | 98 | 16.2 | 5.0 | 5 | 5 | 5 |
| 27 | C | II-51 | $1 \times 10^{-4}$ | 95 | 16.0 | 4.9 | 5 | 5 | 5 |
| 28 | E | — | — | 102 | 16.8 | 5.2 | 5 | 4 | 4 |
| 29 | E | II-17 | $5 \times 10^{-5}$ | 100 | 16.5 | 5.1 | 5 | 5 | 5 |
| 30 | E | II-17 | $1 \times 10^{-4}$ | 98 | 16.0 | 5.0 | 5 | 5 | 5 |
| 31 | E | II-31 | $5 \times 10^{-5}$ | 100 | 16.3 | 5.1 | 5 | 5 | 5 |
| 32 | E | II-31 | $1 \times 10^{-4}$ | 98 | 16.0 | 4.9 | 5 | 5 | 5 |
| 33 | E | II-45 | $5 \times 10^{-5}$ | 98 | 16.3 | 5.0 | 5 | 5 | 5 |
| 34 | E | II-45 | $1 \times 10^{-4}$ | 95 | 15.5 | 4.9 | 5 | 5 | 5 |
| 35 | E | II-51 | $5 \times 10^{-5}$ | 100 | 16.5 | 5.1 | 5 | 5 | 5 |
| 36 | E | II-51 | $1 \times 10^{-4}$ | 98 | 16.0 | 5.0 | 5 | 5 | 5 |

While the invention has been described in detail and with reference to specific embodiments thereof, it will be apparent to one skilled in the art that various changes and modifications can be made therein without departing from the spirit and scope thereof.

What is claimed is:

1. A negative silver halide photographic material comprising a support having thereon at least one light-sensitive silver halide emulsion layer comprising a silver halide emulsion comprising regular silver halide grains containing from 0.3 mol % to 3.0 mol % of silver iodide, said silver halide grains being produced by conversion of silver halide host grains using high silver iodide silver halide grains comprising silver iodide, silver iodobromide, silver iodochlorobromide or silver iodochloride having a silver iodide content of at least 90 mol % in an amount sufficient to provide from 0.1 mol % to 2.5 mol % of silver iodide based on the total silver halide content of the silver halide host grains and the high silver iodide grains, said silver halide host grains comprising silver bromide or silver iodobromide having a silver iodide content of at most 2.5 mol % and a mean grain size of at most 0.7 μm, wherein said conversion is performed in the presence of a compound represented by formula (A):

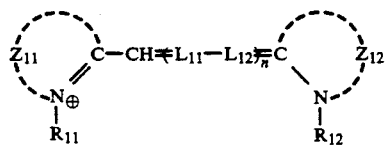

(A)

wherein $Z_{11}$ and $Z_{12}$, which may be the same or different each represents an atomic group necessary for forming a thiazole nucleus, a thiazoline nucleus, a benzothiazole nucleus, a naphthothiazole nucleus, an oxazole nucleus, a benzoxazole nucleus, an oxazoline nucleus, a naphthozazole nucleus, an imidazole nucleus, a benzimidazole nucleus, an imidazoline nucleus, a selenazole nucleus, a selenazoline nucleus, a benzoselenazole nucleus or a naphthoselsenazole nucleus; $R_{11}$ and $R_{12}$, which may be the same or different, each represents a substituted or unsubstituted alkyl group, provided that at least one of $R_{11}$ and $R_{12}$ comprises a sulfo group or a carboxy group; $L_{11}$ and $L_{12}$ each represents a substituted or unsubstituted methine group; and n is from 0, 1 or 2.

2. A negative silver halide photographic material as claimed in claim 1, wherein the amount of high silver iodide silver halide grains used for conversion is an amount sufficient to provide from 0.3 mol % to 1.5 mol % of silver iodide based on said total silver halide content.

3. A negative silver halide photographic material as claimed in claim 1, wherein the average silver iodide content per grain, including said host silver halide grains and said high silver iodide grains, is from 0.5 mol % to 2.0 mol %.

4. A negative silver halide photographic material as claimed in claim 1, wherein said host silver halide grains are present in a monodisperse emulsion.

5. A negative silver halide photographic material as claimed in claim 1, wherein said high silver iodide silver halide grains are contained in a superfine grain emulsion that is added to an emulsion comprising said host silver halide grains.

6. A negative silver halide photographic material as claimed in claim 1, wherein said nucleus formed by $Z_{11}$ or $Z_{12}$ comprises at least one substituent selected from an alkyl group, an alkoxy group, an alkoxycarbonyl group, an aryl group, an aralkyl group, and a halogen atom.

7. A negative silver halide photographic material as claimed in claim 1, wherein said alkyl group represented by $R_{11}$ or $R_{12}$ is substituted with at least one carboxy group, sulfo group, cyano group, halogen atom, hydroxyl group, alkoxycarbonyl group, alkoxy group, aryloxy group, acyloxy group, acyl group, carbamoyl group, sulfamoyl group, or aryl group.

8. A negative silver halide photographic material as claimed in claim 1, wherein said methine group represented by $L_{11}$ or $L_{12}$ is substituted with at least one lower alkyl group, phenyl group, or a benzyl group.

9. A negative silver halide photographic material as claimed in claim 1, wherein said high silver iodide silver halide grains have a mean grain size of at most 0.1 μm.

10. A negative silver halide photographic material as claimed in claim 1, wherein the amount of said compound represented by formula (A) present during conversion is from $1\times10^{-6}$ mol to $1\times10^{-1}$ mol per mol of silver contained in said host silver halide grains and said high silver iodide grains.

11. A negative silver halide photographic material as claimed in claim 1, wherein the silver halide host grains are prepared in the presence of from $10^{-8}$ to $10^{-5}$ mol of an iridium salt or a complex salt thereof per mol of silver in said host grains.

12. A negative silver halide photographic material as claimed in claim 1, wherein said photographic material further comprises at least one hydrazine derivative in said silver halide emulsion layer or an other hydrophilic colloidal layer.

13. A negative silver halide photographic material as claimed in claim 12, wherein said hydrazine derivative is a compound represented by formula (I):

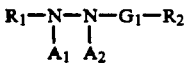

(I)

wherein $R_1$ represents an aliphatic group or an aromatic group; $R_2$ represents hydrogen, an alkyl group, an aryl group, an alkoxyl group, an aryloxy group, an amino group, a hydrazino group, a carbamoyl group, or an oxycarbonyl group; $G_1$ represents a carbonyl group, a sulfonyl group, a sulfoxy group,

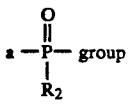

wherein $R_2$ is as defined above,

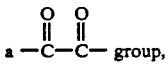

a thiocarbonyl group, or an aminomethylene group; $A_1$ and $A_2$ each represents hydrogen, or one of $A_1$ and $A_2$ represents hydrogen, and the other represents a substituted or unsubstituted alkylsulfonyl group, a substituted or unsubstituted arylsulfonyl group, or a substituted or unsubstituted acyl group.

14. A negative silver halide photographic material as claimed in claim 13, wherein $R_1$ represents an aryl group; $G_1$ represents a carbonyl group; and $R_2$ represents hydrogen, an alkyl group, an aralkyl group or an aryl group.

15. A negative silver halide photographic material as claimed in claim 13, wherein $R_2$ represents a group represented by formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder; $R_3$ represents a group derived by removing one hydrogen from $R_2$; and $R_3$ and $Z_1$ form a cyclic structure together with $G_1$ upon nucleophilic attack of $Z_1$ on $G_1$.

16. A negative silver halide photographic material as claimed in claim 15, wherein said group represented by formula (a) is a group represented by formulae (b) or (c):

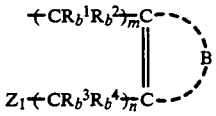

(b)

wherein $Z_1$ is as defined in formula (a); $R_b^1$, $R_b^2$, $R_b^3$, and $R_b^4$, which may be the same or different, each represents hydrogen, an alkyl group, an alkenyl group or an aryl group; B represents an atomic group necessary to form a substituted or unsubstituted 5-membered or 6-membered ring; m and n each represents 0 or 1; and (n+m) is 1 or 2; and

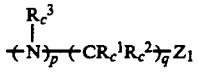

(c)

wherein $Z_1$ is as defined in formula (a); $R_c^1$ and $R_c^2$, which may be the same or different, each represents hydrogen, an alkyl group, an alkenyl group, an aryl group, or a halogen atom; $R_c^3$ represents hydrogen, an alkyl group, an alkenyl group, or an aryl group; p represents 0 or 1; q represents an integer of from 1 to 4; and $R_c^1$, $R_c^2$, and $R_c^3$ may be linked to form a ring as long as $Z_1$ is capable of intramolecular nucleophilic attack on $G_1$.

17. A negative silver halide photographic material as claimed in claim 13, wherein $A_1$ and $A_2$ each represents hydrogen.

18. A negative silver halide photographic material as claimed in claim 13, wherein at least one of $R_1$ and $R_2$ contains a group which accelerates adsorption onto surfaces of silver halide grains.

19. A negative silver halide photographic material as claimed in claim 12, wherein said hydrazine derivative is present in said layer in an amount of from $1\times10^{-6}$ mol to $5\times10^{-2}$ mol per mol of silver halide in said silver halide emulsion layer.

20. A negative silver halide photographic material as claimed in claim 12, wherein said silver halide emulsion layer or another hydrophilic colloid layer of said photographic material further comprises a redox compound capable of releasing a development inhibitor upon being oxidized.

21. A negative silver halide photographic material as claimed in claim 20, wherein said redox compound is represented by formula (II):

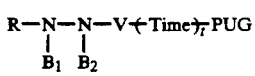

(II)

wherein $B_1$ and $B_2$ each represents hydrogen or one of them represents hydrogen and the other represents a sulfinic acid group or

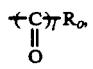

wherein $R_0$ represents an alkyl group, an alkenyl group, an aryl group, an alkoxy group or an aryloxy group, and l represents 1 or 2; Time represents a divalent linking group; t represents 0 or 1; PUG represents a development inhibitor group; V represents a carbonyl group,

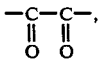

a sulfonyl group, a sulfoxy group, an imino methylene group, a thiocarbonyl group, or

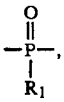

wherein $R_1$ represents an alkoxy group or an aryloxy group; and R represents an aliphatic group, an aromatic group or a heterocyclic group.

22. A negative silver halide photographic material as claimed in claim 21, wherein $B_1$ and $B_2$ each represents hydrogen.

23. A negative silver halide photographic material as claimed in claim 21, wherein said development inhibitor represented by PUG is a group derived from a mercaptotetrazole, mercaptotriazole, mercaptoimidazole, mercaptopyrimidine, mercaptobenzimidazole, mercaptobenzothiazole, mercaptobenzoxazole, mercaptothiadiazole, benzotriazole, benzimidazole, indazole, adenine, guanine, tetrazole, tetraazaindene, triazaindene, or mercaptoaryl.

24. A negative silver halide photographic material as claimed in claim 21, wherein said development inhibitor is substituted with at least one substituent selected from an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a sulfoxy group, a phosphono group, a phosphinyl group, and a phosphonamido group.

25. A negative silver halide photographic material as claimed in claim 21, wherein V represents a carbonyl group.

26. A negative silver halide photographic material as claimed in claim 20, wherein the amount of said redox compound is from $1.0\times10^{-6}$ mol to $5.0\times10^{-2}$ mol per mol of silver halide in said silver halide emulsion layer.

* * * * *